US011435675B2

(12) United States Patent
Kanai et al.

(10) Patent No.: US 11,435,675 B2
(45) Date of Patent: Sep. 6, 2022

(54) IMAGE FORMING APPARATUS WITH FOG SUPPRESSION FEATURE

(71) Applicant: CANON KABUSHIKI KAISHA, Tokyo (JP)

(72) Inventors: Ryosuke Kanai, Kawasaki (JP); Makoto Fukatsu, Suntou-gun (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 16/817,020

(22) Filed: Mar. 12, 2020

(65) Prior Publication Data

US 2020/0310275 A1 Oct. 1, 2020

(30) Foreign Application Priority Data

Mar. 27, 2019 (JP) ..... JP2019-061880

(51) Int. Cl.
*G03G 15/043* (2006.01)
*G03G 15/045* (2006.01)
(Continued)

(52) U.S. Cl.
CPC ..... *G03G 15/043* (2013.01); *G03G 15/045* (2013.01); *G03G 15/0266* (2013.01); *G03G 15/065* (2013.01); *G03G 2215/0465* (2013.01)

(58) Field of Classification Search
CPC .... G03G 15/043; G03G 15/045; G03G 21/08; G03G 2215/0465
See application file for complete search history.

(56) References Cited

U.S. PATENT DOCUMENTS 5,179,411 A * 1/1993 Yoshiuchi ..... G03G 15/0266 399/46
9,599,923 B2 * 3/2017 Kitamura ..... G03G 15/5008
(Continued)

FOREIGN PATENT DOCUMENTS

JP 04204876 A * 7/1992
JP 7-253693 A 10/1995
(Continued)

OTHER PUBLICATIONS

English machine translation of JP 2004-013027_Description (Year: 2004).*
English translation of JPH07253693 (Year: 1995).*

*Primary Examiner* — Arlene Heredia
(74) *Attorney, Agent, or Firm* — Canon U.S.A., Inc. I.P. Division

(57) ABSTRACT

During non-image formation, an exposure unit exposes an image formable region on the image bearing member surface charged by a charging member to light, and, in a state where toner is able to be supplied from a developing member to the image bearing member, during a period from when a developing voltage starts to be changed from a first developing voltage to a second developing voltage smaller than the first developing voltage until the developing voltage is completed to be changed to the second developing voltage. A controller controls the exposure unit so that, after the image bearing member surface exposed to light with a first exposure amount by the exposure unit passes through a development portion, the image bearing member surface exposed to light with a second exposure amount smaller than the first exposure amount by the exposure unit passes through the development portion.

4 Claims, 15 Drawing Sheets

(51) Int. Cl.
*G03G 15/02* (2006.01)
*G03G 15/06* (2006.01)

(56) References Cited

U.S. PATENT DOCUMENTS

| | | | | |
|---|---|---|---|---|
| 9,606,470 | B2 * | 3/2017 | Soda | G03G 15/0283 |
| 9,696,663 | B2 * | 7/2017 | Noguchi | G03G 21/0005 |
| 10,254,699 | B2 * | 4/2019 | Kanno | G03G 15/6564 |

FOREIGN PATENT DOCUMENTS

| | | | | |
|---|---|---|---|---|
| JP | 2001-92331 | A | | 4/2001 |
| JP | 2004013027 | A | * | 1/2004 |
| JP | 2005-345915 | A | | 12/2005 |

* cited by examiner

IMAGE FORMING APPARATUS WITH FOG SUPPRESSION FEATURE

BACKGROUND OF THE DISCLOSURE

Field of the Disclosure

The present disclosure relates to an image forming apparatus, such as a laser printer, a copier, or a facsimile machine, which uses an electrophotographic recording system.

Description of the Related Art

In an image forming apparatus, a surface of an electrophotographic photosensitive member (hereinafter, referred to as a photosensitive drum or a drum) is uniformly charged by a charging member, and the charged surface of the photosensitive drum is exposed to light by an exposure unit to form an electrostatic latent image. Then, the electrostatic latent image is developed by a developing unit to form a toner image by using developer (hereinafter, referred to as toner), and the toner image is transferred onto a recording material by a transfer member. Then, by using a fixing device, the toner image is fixed onto the recording material and output as an image. On the other hand, after the transfer of the toner image, transfer-residual toner remaining on the surface of the photosensitive drum is cleaned by a cleaning member to prepare for a next image forming operation.

The developing unit is provided with a developing member as a developer bearing member for bearing toner and is applied with a developing voltage. Even in a non-image forming portion where no electrostatic latent image is developed, the developing voltage needs to be applied to the developing member in order to suppress fog. The fog refers to a phenomenon that toner is attached in a non-image forming region formed on the surface of the photosensitive drum. Back contrast that is a difference between a surface potential of the photosensitive drum and the developing voltage in a development portion facing the developing member largely contributes to the fog. When the back contrast is small, a potential difference between the photosensitive drum and the developing member is small, so that force by which toner having a normal polarity is electrically attracted in a direction of the developing member is weak. Thus, the toner may transfer to the non-image forming portion formed on the surface of the photosensitive drum. On the other hand, when the back contrast is large, the potential difference between the photosensitive drum and the developing member is large, so that the force by which toner having the normal polarity is electrically attracted in the direction of the developing member is strong, but toner charged to a polarity opposite to the normal polarity transfers to the non-image forming portion. Accordingly, by controlling the back contrast in a proper range, toner consumption due to the fog is able to be suppressed.

Moreover, an image forming apparatus not including a developing contact/separation unit provided so as to allow the developing member to be in contact with the photosensitive drum or allow the developing member to be separated from the photosensitive drum is also proposed in order to reduce cost and a size. In such an image forming apparatus, proper back contrast is not formed at a time of activation of a motor, during which no potential is formed on the surface of the photosensitive drum that has been left for a long time, for example, and when the developing member is arranged at a distance where toner is able to be supplied to the photosensitive drum in a state where proper back contrast is not formed, the fog is generated. Then, Japanese Patent Laid-Open No. 2005-345915 discloses a configuration in which a developing voltage whose polarity is opposite to a normal polarity of toner is applied to a developing member at a time of activation of a motor. According to the configuration described in Japanese Patent Laid-Open No. 2005-345915, even when no potential is formed on a surface of a photosensitive drum at the time of activation of the motor, the back contrast at a development position is able to be properly controlled, thus making it possible to suppress generation of the fog.

However, even when the developing voltage is controlled at the time of activation of the motor to suppress the fog as in Japanese Patent Laid-Open No. 2005-345915, there is a problem as follows in a process of forming the surface potential of the photosensitive drum in order to perform image formation. In the process of forming the surface potential of the photosensitive drum, the proper back contrast needs to be formed by controlling the developing voltage in accordance with a charging voltage applied to form the surface potential of the photosensitive drum. However, a developing high-voltage power source that outputs the developing voltage and a charging high-voltage power source that outputs the charging voltage to form the surface potential of the photosensitive drum have respective rising and falling characteristics. When both of them have different characteristics, proper back contrast is difficult to be formed in the development portion and the fog may be generated.

SUMMARY OF THE DISCLOSURE

In view of the aforementioned circumstances, according to the disclosure, fog generated when a high-voltage power source rises or falls is suppressed so that toner consumption is suppressed.

According to a first aspect of the disclosure, an image forming apparatus of the disclosure includes an image bearing member capable of rotation; a charging member that charges a surface of the image bearing member; an exposure unit that exposes the surface of the image bearing member charged by the charging member to light; a developing member that supplies toner to the image bearing member in a development portion facing the image bearing member and forms a toner image; a charging voltage applying unit that applies a charging voltage to the charging member; a developing voltage applying unit that applies a developing voltage to the developing member, and a controller that controls the exposure unit, the charging voltage applying unit, and the developing voltage applying unit, wherein, during non-image formation in which the toner image is not formed on the surface of the image bearing member, the exposure unit exposes an image formable region on the surface of the image bearing member charged by the charging member to light, and wherein, in a state where toner is able to be supplied from the developing member to the image bearing member, during a period from when the developing voltage starts to be changed from a first developing voltage to a second developing voltage smaller than the first developing voltage until the developing voltage is completed to be changed to the second developing voltage, the controller controls the exposure unit so that, after the surface of the image bearing member exposed to light with a first exposure amount by the exposure unit passes through the development portion, the surface of the image bearing member exposed to light with a second exposure amount smaller than the first exposure amount by the exposure unit passes through the development portion.

Further features and aspects of the present disclosure will become apparent from the following description of disclosure embodiments with reference to the attached drawings.

DESCRIPTION OF THE EMBODIMENTS

An embodiment of the disclosure will be exemplarily described in detail below on the basis of disclosure embodiments with reference to drawings. Note that, dimensions, materials, shapes, and relative arrangement of components described in the embodiment are to be appropriately changed in accordance with a configuration of an apparatus to which the disclosure is applied and various conditions. That is, a scope of the disclosure is not intended to be limited only to the following embodiment.

First Example Embodiment

1. Example Image Forming Apparatus

Figure 1:
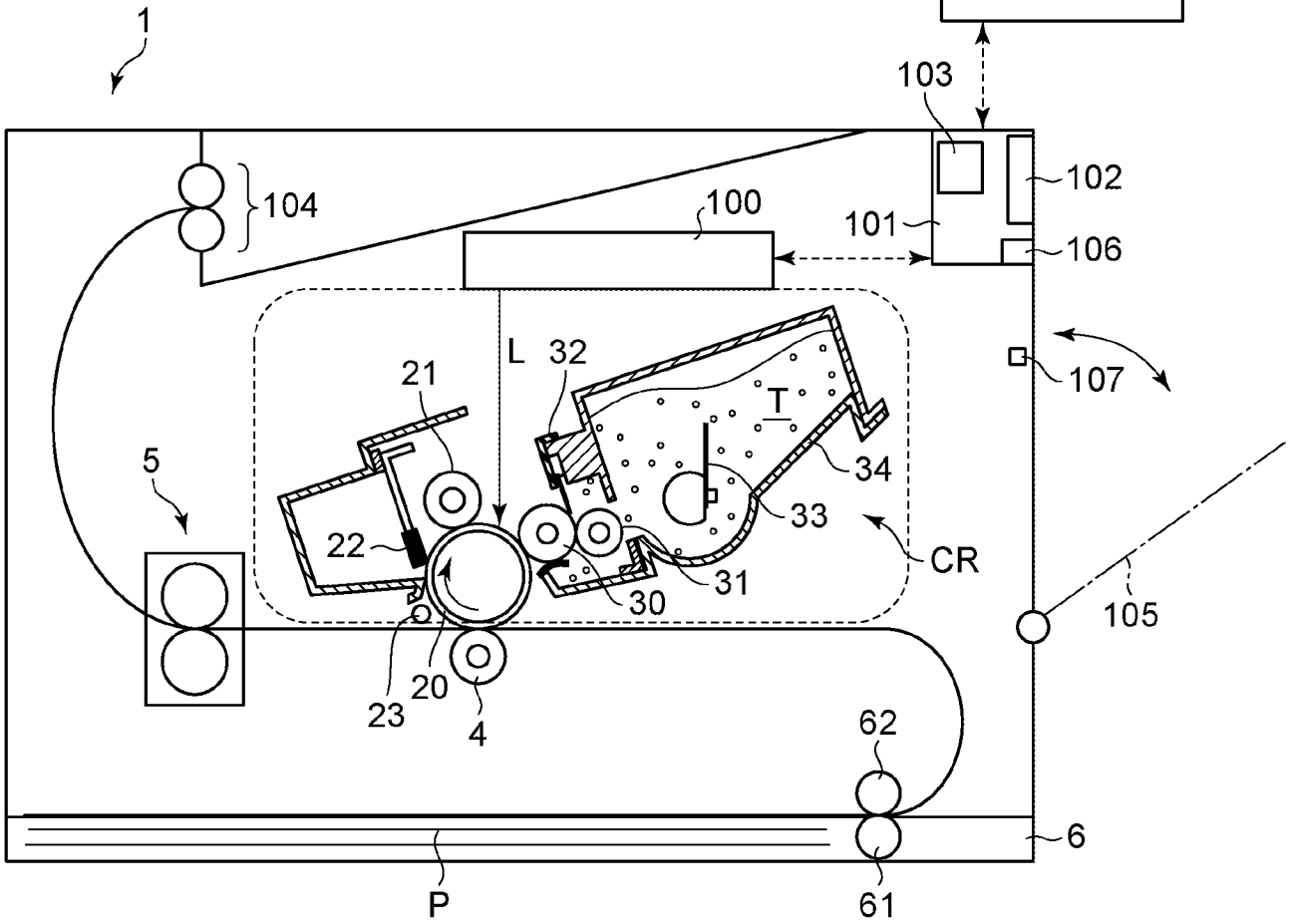
FIG. 1 is a sectional view of an image forming apparatus according to a first example embodiment.
Figure 2:
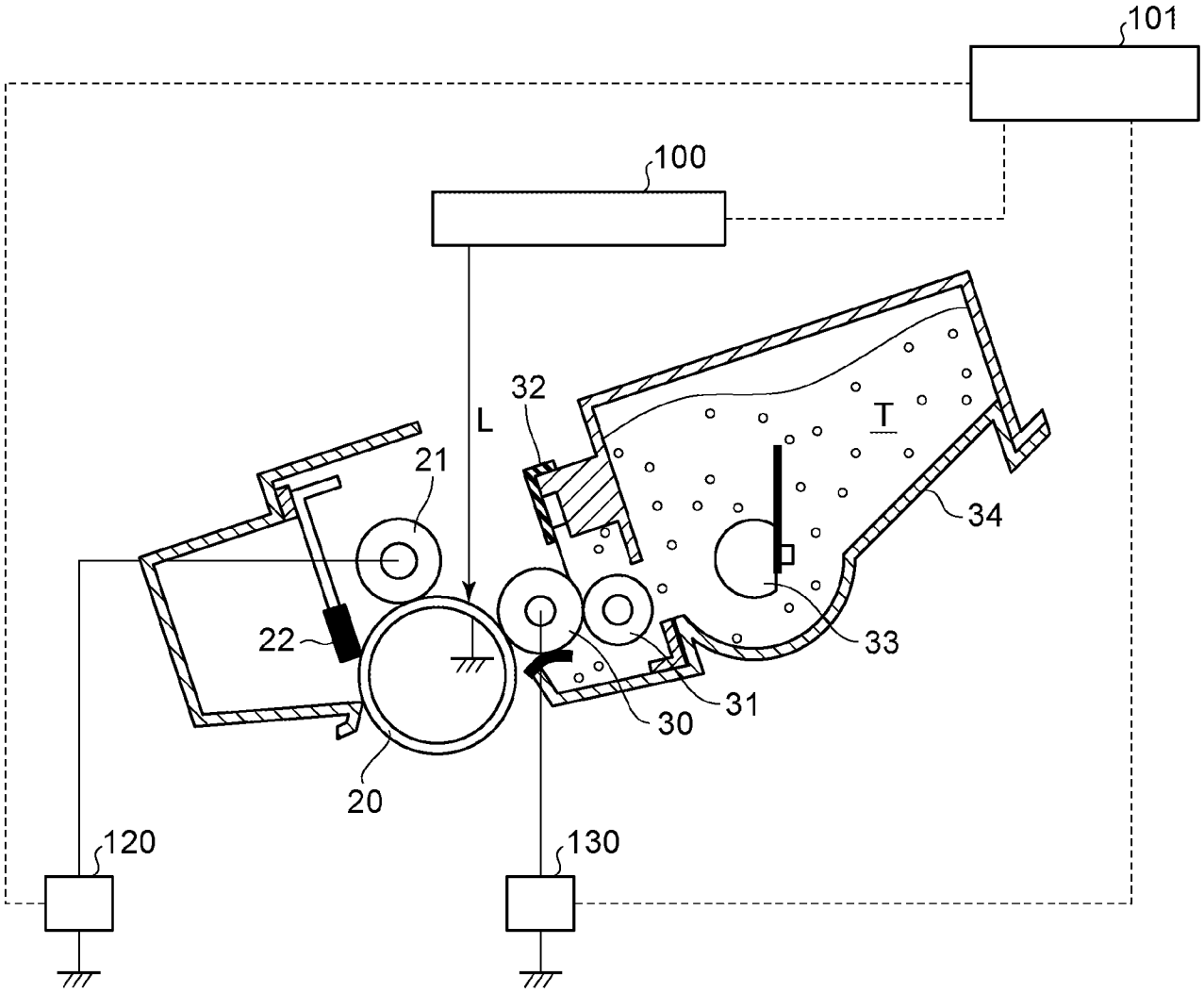
FIG. 2 is a block diagram of the image forming apparatus according to the first example embodiment.

FIG. 1 is a sectional view of an example image forming apparatus 1 according to a first example embodiment. FIG. 2 is a view obtained by adding a control block diagram to a sectional view of the image forming apparatus 1 according to the first example embodiment.

The image forming apparatus 1 according to the first example embodiment is a laser beam printer of a cartridge type using an electrophotographic process. That is, the image forming apparatus 1 is connected to a host apparatus 200 such as a personal computer or an image reader via a LAN (Local Area Network), and performs an image forming operation for a recording material P having a sheet shape on the basis of electrical image information input from the host apparatus 200 to a control portion 101. The control portion 101 exchanges various kinds of electrical information with the host apparatus 200 and a display portion 102 and integrally controls the image forming operation of the image forming apparatus 1 in accordance with a predetermined control program or a reference table. The control portion 101 has a storage portion 103 in which information of the image forming apparatus 1 and information of a cartridge CR are stored.

The cartridge CR in the first example embodiment is a cartridge integrally including a photosensitive drum 20 as a rotatable image bearing member, a charging roller 21 as a charging member that acts on the photosensitive drum 20, a cleaning blade 22, and a developing roller 30 as a developing member that is a developer bearing member. The cartridge CR is configured to be attachable and detachable by opening a main body door 105 as indicated by a one-dot-dash line relative to the image forming apparatus 1 and greatly opening an inside of the image forming apparatus 1.

When the cartridge CR is sufficiently inserted into the image forming apparatus 1, the cartridge CR is held at a predetermined attaching position. The photosensitive drum 20 is set at a position where the photosensitive drum 20 is able to be irradiated with laser L from an exposure unit 100. In addition, a lower surface of the photosensitive drum 20 is set to face a transfer roller 4. Then, by closing the main body door 105, installation of the cartridge CR in the image forming apparatus 1 is completed.

In the image forming apparatus 1, a door switch 107 (safety switch or kill switch) is disposed. The door switch 107 is turned OFF when the main body door 105 is opened, and is turned ON when the main body door 105 is closed.

When the cartridge CR is attached at a predetermined position in the image forming apparatus 1 and the main body door 105 is closed, the cartridge CR is brought into a state of being mechanically and electrically coupled to the image forming apparatus 1. That is, driven members (such as the photosensitive drum 20 and the developing roller 30) on the cartridge CR side are in a state of being allowed to be driven by a driving unit (not illustrated) on the image forming apparatus 1 side. In addition, as illustrated in FIG. 2, a charging voltage applying portion 120 as the charging voltage applying unit and a developing voltage applying portion 130 as the developing voltage applying unit each as a voltage applying power source portion on the image forming apparatus 1 side are able to apply predetermined voltages to the charging roller 21 and the developing roller 30 on the cartridge CR side. Moreover, with respect to the photosensitive drum 20 on the cartridge CR side, the exposure unit 100 is able to expose the surface of the photosensitive drum 20 to light.

In a state where a main power supply switch 106 is turned ON, the cartridge CR is attached, and the door switch 107 is turned ON by closing the main body door 105, the image forming apparatus 1 is in a wait state (standby state) where the image forming operation is allowed.

In the wait state, when electrical image information to be printed is input from the host apparatus 200 to the control portion 101 as the controller, the control portion 101 processes the input image information by an image processing portion (not illustrated) and performs an image forming process on the basis of an image formation start (print start) signal. That is, a driving motor (not illustrated) is activated, the photosensitive drum 20 is driven to rotate at a predetermined moving speed (process speed Vp), and the developing roller 30 is driven to rotate at a predetermined circumferential speed ratio relative to the photosensitive drum 20.

Next, each configuration of the image forming apparatus 1 in the first example embodiment will be described in detail.

In the first example embodiment, the photosensitive drum 20 is an electrophotographic photosensitive member of a rotating drum type. The photosensitive drum 20 may be configured in such a manner that a photosensitive material such as an OPC (organic photoconductor), amorphous selenium, or amorphous silicon is formed on a drum substrate on a cylinder made of aluminum or nickel and having φ of 24 mm. The photosensitive drum 20 is supported by the image forming apparatus 1 so as to rotate freely and is driven to rotate at a process speed Vp=150 mm/sec. When driving from a driving source is transmitted, the photosensitive drum 20 is driven to rotate in a direction of an arrow in FIG. 1. Note that, a thickness of the photosensitive material is set to 15 μm in the first example embodiment. The photosensitive drum 20 that is driven to rotate has a surface uniformly charged by the charging roller 21 to have a predetermined polarity and a predetermined potential. The charging roller 21 is a single-layer roller formed of conductive core metal and a conductive rubber layer and has an outer diameter of 7.5 mm and a volume resistivity of $10^3$ to $10^6$ Ω·cm. Moreover, a predetermined charging voltage is applied to the conductive core metal by the charging voltage applying portion 120. As an output source of the charging voltage, a direct current high-voltage power source is used. Note that, the charging voltage having a negative polarity is applied to the charging roller 21 in the first example embodiment.

The surface of the photosensitive drum 20 processed by charging undergoes laser scanning exposure by the exposure unit 100. The exposure unit 100 includes a laser output portion that outputs a laser beam L modulated in accordance with a time-series electrical digital pixel signal to be input, a rotational polygon mirror (polygon mirror), a reflecting mirror, and the like, and performs main scanning exposure on the surface of the photosensitive drum 20 with the laser beam L. The laser light L is radiated to the surface of the photosensitive drum 20 and an electrostatic latent image is formed on the surface of the photosensitive drum 20 with a predetermined resolution. The exposure unit 100 in the first example embodiment is a laser exposure unit and an exposure amount is variable when the control portion 101 controls a current flowing in a laser diode of the exposure unit 100.

The electrostatic latent image formed on the surface of the photosensitive drum 20 by the exposure unit 100 is developed as a toner image with toner T as developer on the developing roller 30. In the first example embodiment, the electrostatic latent image is reversal-developed by a contact developing system using negative charging non-magnetic single component toner (negative toner).

The developing roller 30 and the photosensitive drum 20 are arranged so as to face each other in a contact manner in a development portion and are driven to rotate at a predetermined speed. While the cartridge CR is attached to the image forming apparatus 1, the developing roller 30 in the first example embodiment always contacts the photosensitive drum 20 not only during image formation but also during the other period. That is, the image forming apparatus 1 does not include a contact/separation unit that separates the developing roller 30 from the photosensitive drum 20. A supply roller 31 contacts the developing roller 30 to rotate and supplies the toner T. A developing blade 32 is an elastic member and arranged in contact with the developing roller 30, while being warped against elasticity of the developing roller 30. A stirring member 33 rotates at a predetermined speed in association with the rotation of the developing roller 30 to stir the toner T in a developer container 34 and supply the toner T to the supply roller 31. The toner T is borne by the developing roller 30, achieves a predetermined layer thickness by the developing blade 32, and is conveyed to the development portion facing the photosensitive drum 20. In the first example embodiment, the developing roller 30 rotates at a speed that is 1.4 times of a surficial moving speed of the photosensitive drum 20. The developing roller 30 is applied with a predetermined developing voltage by the developing voltage applying portion 130 provided in the image forming apparatus 1 and thereby develops the electrostatic latent image. As an output source of the developing voltage, a direct current high-voltage power source is used.

On the other hand, a feeding roller 61 is driven to rotate at a predetermined control timing so that the recording material P stacked and contained in a sheet feed cassette 6 is fed. One recording material P separated by a separating roller 62 is introduced into a transfer nip portion that is a contact portion between the photosensitive drum 20 and the transfer roller 4. The transfer roller 4 is made of conductive core metal and conductive sponge rubber, which is mainly composed of NBR (Nitrile-Butadiene-Rubber) Hydrin rubber and has an elastic member at a pressure contact part against the photosensitive drum 20, and is 12.5 mm in outer diameter and 30° in hardness (Asker-C, 500 gf load). In a process where the recording material P is conveyed through the transfer nip portion while being held, a transfer voltage at a predetermined potential is applied to the transfer roller 4 and the toner image formed on the surface of the photosensitive drum 20 is sequentially electrostatically transferred onto the surface of the recording material P. The recording material P passing through the transfer nip portion is separated from the surface of the photosensitive drum 20 and introduced into a fixing device 5 through a conveyance unit so that the toner image is fixed as a fixed image onto the surface of the recording material P. A sheet discharge roller pair 104 discharges the recording material P out of the apparatus.

On the other hand, the surface of the photosensitive drum 20 after the recording material P is separated therefrom is allowed to be exposed to light by a pre-charge exposure unit 23 installed in the image forming apparatus 1 and composed of an LED and a light guide and has electricity appropriately removed. Moreover, a residual deposit such as transfer-residual toner is removed and cleaned by the cleaning blade 22. Thus, the photosensitive drum 20 is repeatedly used for image formation.

Next, a relationship of potentials around the photosensitive drum 20 in the image forming process of the first example embodiment will be described herein below.

In the first example embodiment, the surface of the photosensitive drum 20 that is charged to have a uniform charging potential Vd (dark portion potential: −500 V) by the charging roller 21 applied with the charging voltage of −1000 V is exposed to light for image formation, and an exposure amount and an exposure region are decided in accordance with an image signal. An image forming portion is exposed to light by the exposure unit 100 and adjusted to have a post-exposure potential Vl (light portion potential: −150 V) as an image portion potential. In the first example embodiment, an exposure amount E0 to form Vl is set to 0.35 μJ/cm$^2$. Relative to the light portion potential Vl on the photosensitive drum 20, a developing voltage Vdc (developing potential: −350 V) is applied to the developing roller 30 that develops the toner image. The image forming portion and a non-image forming portion described later are formed in an image formable region on the surface of the photosensitive drum 20. The image formable region is a region where the toner T is able to be supplied from the developing roller 30 to the surface of the photosensitive drum 20 and where the toner T is able to be borne by a surface of the developing roller 30.

That is, development contrast Vcont that is a potential difference between the light portion potential Vl of the image forming portion on the photosensitive drum 20 and the developing voltage Vdc is 200 V and back contrast Vbc that is a potential difference between the dark portion potential Vd on the photosensitive drum 20 and the developing voltage Vdc is 150 V. This makes it possible to appropriately output an image such as a solid black image, a halftone image, or an outline character.

Here, the development contrast Vcont and the back contrast Vbc that are formed by the surface of the photosensitive drum 20 and the developing voltage are expressed as a potential difference between the surface potential of the photosensitive drum 20 and the developing voltage applied to the developing roller 30 in the development portion. When image formation is performed without performing appropriate potential setting, an adverse effect in an image is caused on the recording material P. Specifically, when the development contrast Vcont is small, an amount of toner developed on the photosensitive drum 20 is reduced, so that low density occurs. When the development contrast Vcont is large, the amount of toner developed on the photosensitive drum 20 is increased, so that fixing failure occurs. Thus, the development contrast Vcont needs to be properly adjusted in view of them.

Moreover, the voltage in the first example embodiment is expressed as a potential difference relative to an earth potential (0 V). Thus, the developing voltage Vdc=−350 V means that a potential difference of −350 V is generated due to the developing voltage applied to the core metal of the developing roller 30 relative to the earth potential. The same is also applied to the charging voltage or the like.

2. Example Back Contrast Vbc and Fog

Next, a reason why the back contrast Vbc is controlled will be described. The back contrast Vbc is properly controlled so that unnecessary toner is not attached to the non-image forming portion (white background portion) where image formation is not performed. The unnecessary toner is called fog toner and a phenomenon that the fog toner is generated is called fog. When the fog is generated, toner is attached to a portion other than a portion where an image is originally desired to be formed so that a tint is generated in the white background portion, which can be disadvantageous for a user. When the fog is generated during a period other than during image formation, the fog toner is not used for anything and is collected by the cleaning blade 22, which leads to waste consumption of the toner T. When the back contrast Vbc is small, an electric field by which the toner T charged to a negative polarity that is a normal polarity in the first example embodiment is kept on the developing roller 30 is weakened and the fog toner is generated in the non-image forming portion on the photosensitive drum 20. On the other hand, when the back contrast Vbc is large, the fog in which the toner T charged to a positive polarity opposite to the normal polarity on the developing roller 30 is attached to the non-image forming portion on the photosensitive drum 20 is generated. The fog in which the toner T charged to the negative polarity that is the normal polarity is attached to the non-image forming portion formed on the surface of the photosensitive drum 20 is called normal fog. In addition, the fog in which the toner T charged to the positive polarity that is opposite to the normal polarity is attached to the non-image forming portion on the photosensitive drum 20 is called reversal fog. Thus, the back contrast Vbc needs to be set so that the fog toner, including the normal fog and the reversal fog, is least.

Moreover, it is known that 1-dot density and a line width vary depending on the back contrast Vbc and the development contrast Vcont. Thus, while most suitable back contrast Vbc against the fog is set, suitable development contrast Vcont for the 1-dot density and the line width is set. In order to satisfy the aforementioned conditions, setting voltages of the charging voltage applying portion 120 and the developing voltage applying portion 130 and exposure intensity of the exposure unit 100 are set.

Figure 3:
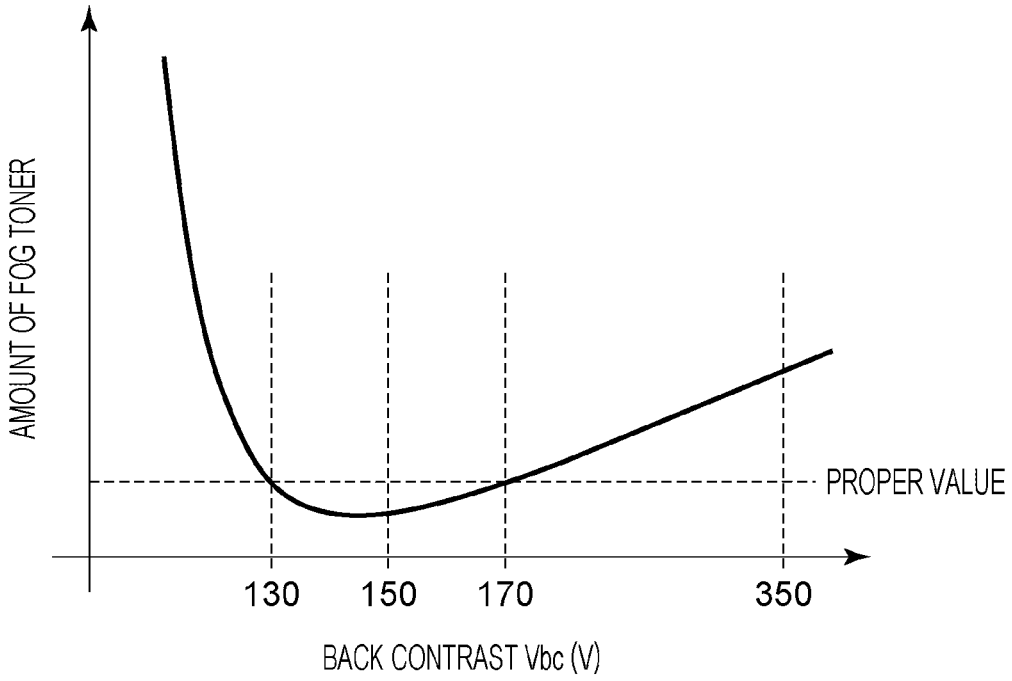
FIG. 3 illustrates a relationship between back contrast and fog according to the first example embodiment.

FIG. 3 illustrates a relationship between the back contrast Vbc and an amount of the fog toner. In a graph, a horizontal axis indicates the back contrast Vbc and a vertical axis indicates the amount of the fog toner. The amount of the fog toner is measured in such a manner that a Mylar tape is applied onto the photosensitive drum 20 and the toner on the photosensitive drum 20 is transferred onto the tape, and after putting the tape on a reference sheet, density of the toner is measured by a reflection density meter (TC-6DS/A) manufactured by Tokyo Denshoku Co., Ltd. The amount of the fog toner is calculated from an amount of the toner on the photosensitive drum 20 when an image forming operation is performed by using the image forming apparatus 1 and development is performed by changing the back contrast Vbc without using a recording material P. Since the fog toner is not visually recognized when the amount thereof is equal to or less than a fixed value, there is no problem in an image, but when the amount of the fog toner increases, the fog toner is able to be visually recognized and an adverse effect in an image is caused. Further, when the amount of the fog toner increases, a waste toner consumption amount increases, so that it is desirable that the amount of the fog toner is set as little as possible. Accordingly, the back contrast Vbc is normally set so that the fog toner is not able to be visually recognized and a toner consumption amount is small.

As described above, the back contrast Vbc largely contributes to the fog. When the back contrast Vbc is small, force by which the toner T having the normal polarity is electrically attracted in a direction of the developing roller 30 in the development portion is weak. Thus, the toner T transfers to the non-image forming portion formed on the surface of the photosensitive drum 20. As illustrated in FIG. 3, in a region where the back contrast Vbc is small, the amount of the fog toner tends to increase due to an increase in an amount of the normal fog toner. On the other hand, when the back contrast Vbc is large, the force by which the toner T having the normal polarity is electrically attracted in the direction of the developing roller 30 in the development portion is strong, but the toner T charged to a polarity opposite to the normal polarity transfers to the non-image forming portion formed on the surface of the photosensitive drum 20. Accordingly, as illustrated in FIG. 3, in a region where the back contrast Vbc is large, an amount of the reversal fog toner tends to increase. The small back contrast Vbc causes the normal fog and the large back contrast Vbc causes the reversal fog. Thus, toner consumption due to the fog needs to be suppressed by controlling the back contrast Vbc in the proper range. In the first example embodiment, by setting the back contrast Vbc to 150 V in a region where the amount of the fog toner is lower than a proper value as illustrated in FIG. 3, the fog during image formation and toner consumption during non-image formation are suppressed. It is desirable that the back contrast Vbc is set in a range from 130 V to 170 V because the fog toner in the range is not able to be recognized by visual observation and toner consumption is particularly suppressed.

3. Example Operational Step of Image Forming Apparatus

Figure 4:
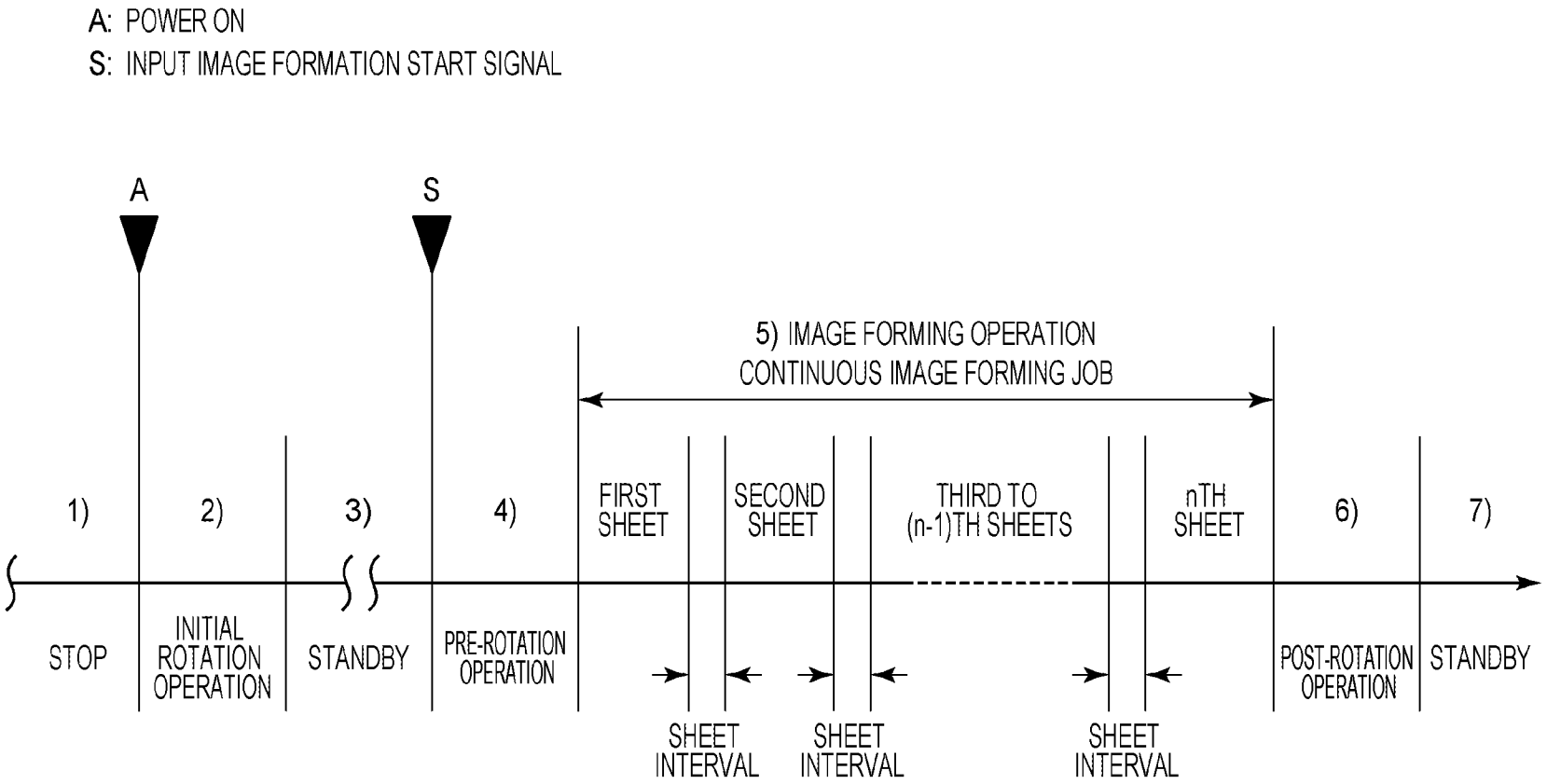
FIG. 4 is an operational step chart of an image forming operation in the first example embodiment.

Next, an example image forming operation will be described. FIG. 4 is an operational step chart of the image forming apparatus 1. A description will be given on the basis of FIG. 4.

1) Example Stop State

When the image forming apparatus 1 is powered OFF, that is, the main power supply switch 106 is in an OFF state, or when the door 105 is opened and the door switch 107 is in an OFF state, the image forming apparatus 1 is powered OFF and held at a stop state.

2) Example Initial Rotation Operation (Multiple Pre-Rotation Operation)

An initial rotation operation is an operation performed when the image forming apparatus 1 is powered on (power ON) (A in FIG. 4). That is, the operation is performed for warming a necessary processing device, which involves driving to rotate the photosensitive drum 20, by activating a driving motor (main motor: not illustrated) when the image forming apparatus is 1 powered on. A time when the image forming apparatus 1 is powered on corresponds to a time when the main power supply switch 106 is shifted from the OFF state to an ON state in a state where the door switch 107 is in an ON state (with the door 105 closed). Alternatively, the time corresponds to a time when the door switch 107 is shifted from the OFF state (with the door 105 open) to the ON state (with the door 105 closed) in a state where the main power supply switch 106 is in the ON state. In both cases, the image forming apparatus 1 is powered ON and held at an operable state.

The initial rotation operation is a preparation operation for causing the image forming apparatus 1 to perform stable image formation. For example, a state of the cartridge CR is detected, and the control portion 101 performs control to decide proper setting of charging, developing, and a transfer voltage in accordance with the state. Alternatively, processing control is performed, for example, so that a constant charging voltage is applied by the charging voltage applying portion 120 or light for exposure is irradiated by the exposure unit 100 in order to obtain a uniform surface potential of the photosensitive drum 20.

3) Standby (Wait)

When the predetermined initial rotation operation ends, the driving of the driving motor is stopped, and the image forming apparatus 1 is held at a standby state until an image formation start signal S is input.

4) Example Pre-Rotation Operation

In response to the input of the image formation start signal S, the driving motor is driven again, and a predetermined pre-operation for image formation involving driving to rotate the photosensitive drum 20 is performed. More specifically, the operation is performed in order of a: the control portion 101 receives the image formation start signal S, b: an image is decompressed by a formatter, and c: the pre-rotation operation starts. Note that, a decompression time in the step b varies depending on an amount of data of the image or a processing speed of the formatter. When the image formation start signal S is input during 2) initial rotation operation described above, the pre-rotation operation is sequentially performed without 3) standby described above after the initial rotation operation ends.

5) Example Image Forming Operation

After the pre-rotation operation ends, an image forming operation (monochromatic print) for predetermined one sheet or an image forming operation (continuous image forming job: multiple print) for a predetermined plurality of sheets is sequentially performed, and a recording material P or recording materials P having an image formed thereon are output. A sheet interval indicated in FIG. 4 refers to an interval from when a rear edge of a recording material P passes through the transfer nip portion till when a leading edge of a next recording material P reaches the transfer nip portion in a transfer portion in a case of the continuous image forming job.

6) Example Post-Rotation Operation

Also after the image forming operation for the predetermined one sheet or the predetermined plurality of sheets ends, the driving motor is sequentially driven for a predetermined time so that a predetermined image formation end operation involving driving to rotate the photosensitive drum 20 is performed.

7) Standby

After the post-rotation operation ends, the driving of the driving motor is stopped, and the image forming apparatus 1 is held at the standby state until a next image formation start signal S is input. When the next image formation start signal S is input, the operation shifts to 4) pre-rotation operation described above.

4. Example Control in Pre-Rotation Operation

Figure 5:
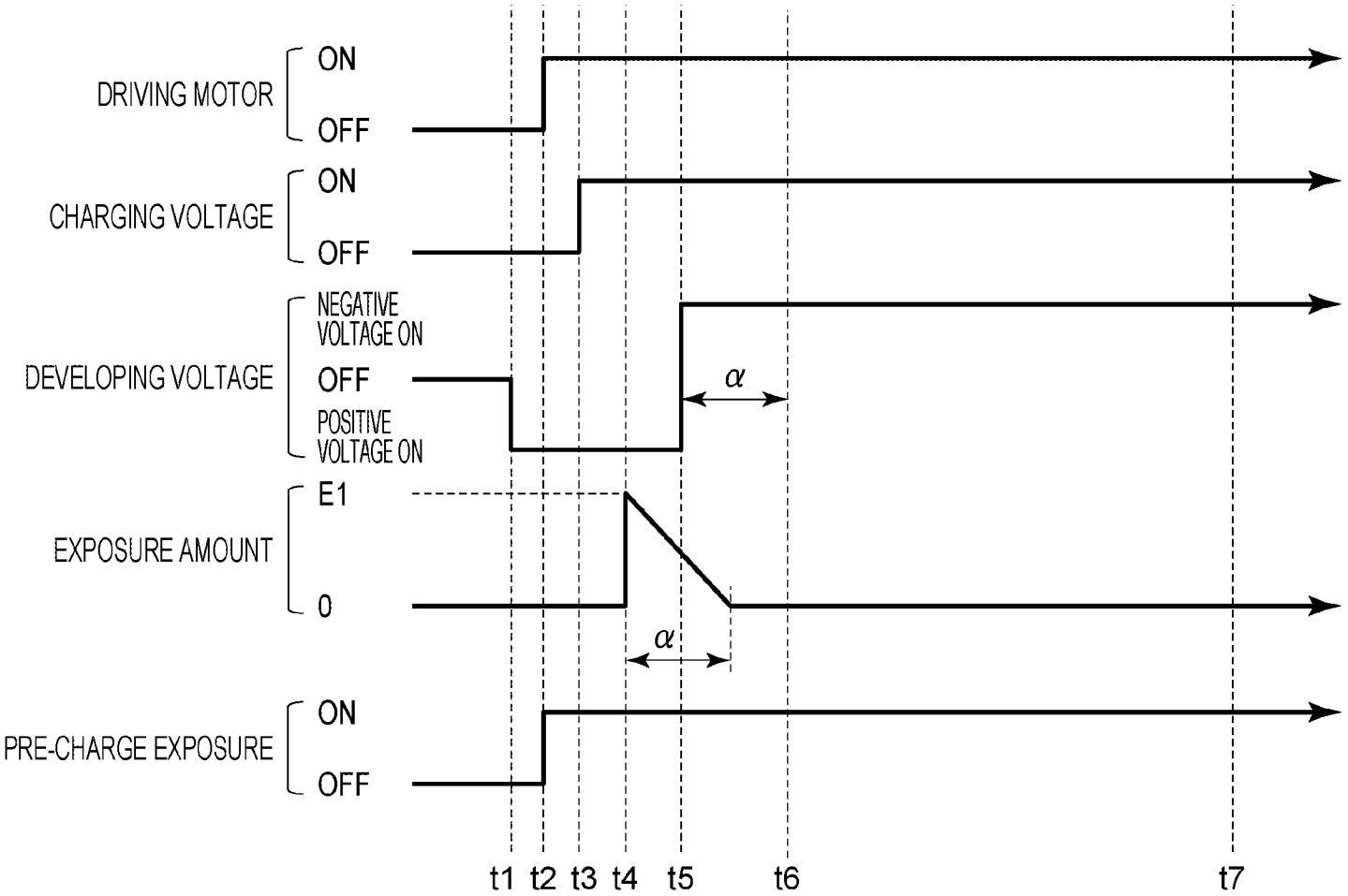
FIG. 5 is a sequence chart of a pre-rotation operation of the image forming apparatus in the first example embodiment.
Figure 6:
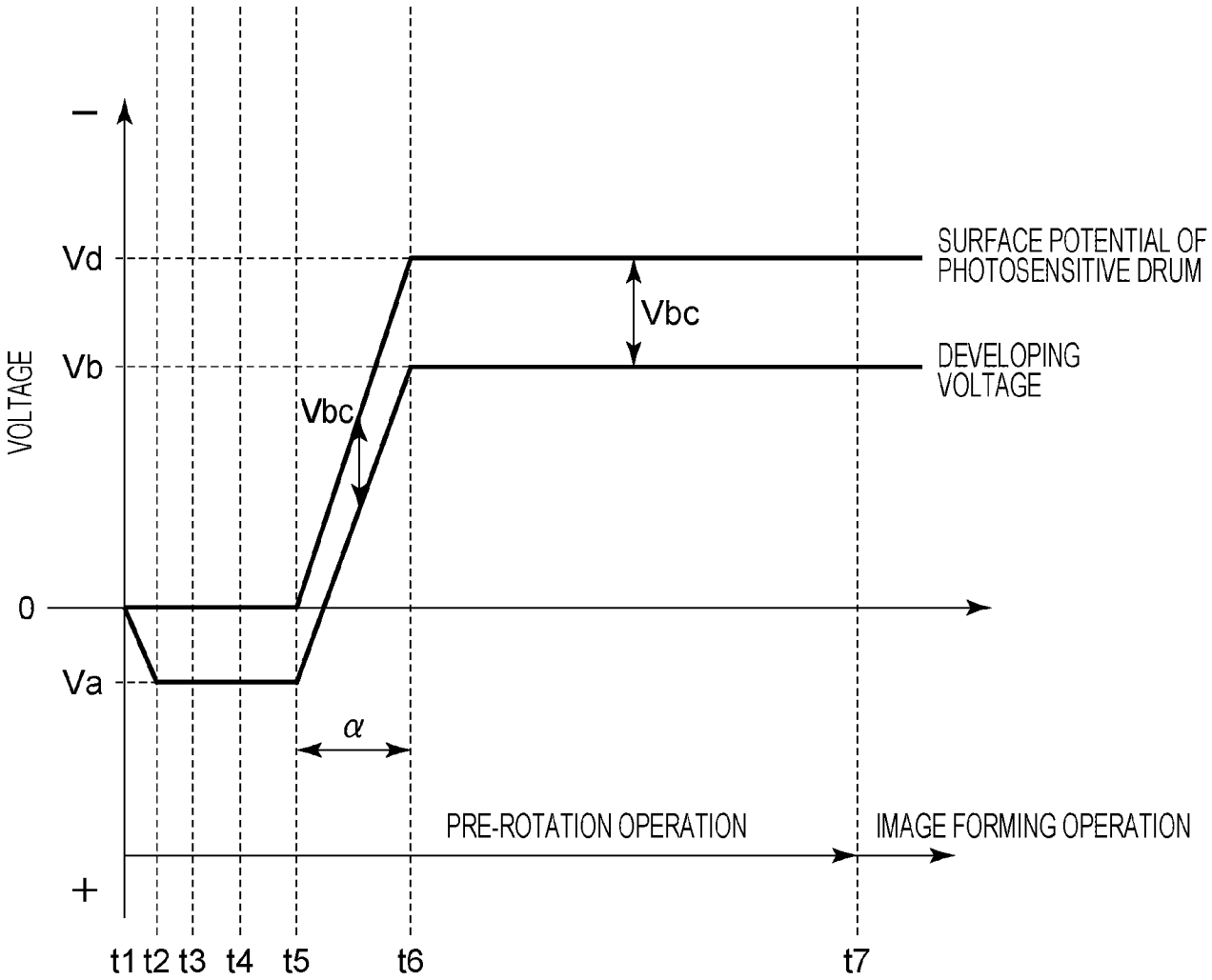
FIG. 6 illustrates shift of a voltage of the pre-rotation operation of the image forming apparatus in the first example embodiment.

With reference to FIGS. 5 and 6, 4) pre-rotation operation described above in the first example embodiment will be described more specifically. FIG. 5 is a timing chart of the driving motor, the charging voltage, the developing voltage, the exposure amount, and pre-charge exposure during the pre-rotation operation. FIG. 6 illustrates shift with time of the surface potential of the photosensitive drum 20 and the developing voltage in the development portion during the pre-rotation operation.

When the image formation start signal S is input at t1 illustrated in FIGS. 5 and 6, the developing voltage having the positive polarity is turned ON and the positive developing voltage Va is applied to the developing roller 30. At this time, since the surface potential of the photosensitive drum 20 is substantially 0 V, the back contrast Vbc=Va is provided between the photosensitive drum 20 and the developing roller 30 in the development portion. The positive developing voltage Va is set so that the back contrast Vbc is in the proper range where no fog is generated. In the first example embodiment, Va=Vbc=150 V is set. In such a state, the driving motor is turned ON at t2. When the driving motor is turned ON, both the photosensitive drum 20 and the developing roller 30 start to be driven to rotate. The pre-charge exposure unit 23 is also turned ON as the driving motor is turned ON.

Subsequently, the charging voltage is turned ON at t3 to start charging of the surface of the photosensitive drum 20. In the first example embodiment, a rising time of the charging voltage, during which the surface potential of the photosensitive drum 20 reaches Vd after the charging voltage is turned ON, is 30 msec. The exposure unit 100 is caused to emit light at t4 where the charged surface of the photosensitive drum 20 reaches an exposure portion facing the exposure unit 100 upon driving for rotation. At t5 where an exposed surface obtained by exposing the surface of the photosensitive drum 20 to light at t4 reaches a development position, the developing voltage Vdc is switched from the positive developing voltage Va to a negative developing voltage Vb. In the first example embodiment, after a negative developing voltage is turned ON at t5, the negative developing voltage Vb during image formation is provided at t6. A time α from t5 to t6 is a rising time of the negative developing voltage Vb. In the first example embodiment, the rising time α of the negative developing voltage Vb is 75 msec and longer than 30 msec as the rising time of the charging voltage. As a reason why a rising characteristic of the charging voltage and a rising characteristic of the developing voltage are different, a performance difference of high-voltage transformers is cited. An output value and an output range of the charging voltage are typically greater than those of the developing voltage. Thus, a difference is also generated between the rising characteristics of both of them. Here, the control portion 101 controls the exposure amount of the exposure unit 100 so that the back contrast Vbc that is a difference between the surface potential of the photosensitive drum 20 and the developing voltage Vdc is in a fixed range, in consideration of the rising characteristic of the developing voltage Vdc. Specifically, after the surface of the photosensitive drum 20 is irradiated with light with an exposure amount E1 by the exposure unit 100 at t4, the exposure amount is controlled to be gradually reduced, and after an elapsed time of α=75 msec from t4, the exposure unit 100 is controlled to be turned OFF. In this manner, by controlling the exposure amount of the exposure unit 100, the back contrast Vbc is in the proper range, so that it is possible to suppress the fog and suppress toner consumption.

In a period from t6 to t7, the dark portion potential Vd that is the surface potential of the photosensitive drum 20 and the negative developing voltage Vb of the developing voltage Vdc are stable, and after t7 where preheating of the fixing device 5 is completed, the operation shifts to the image forming operation.

As described above, the proper range of the back contrast Vbc in the first example embodiment is 130 V or more and 170 V or less. During a period of the rising time α of the developing voltage, at least the back contrast Vbc is set to be in the predetermined range. Various potentials in the first example embodiment are set as Va=+150 V, Vd=−500 V, Vb=−350 V, and E1=0.40 μJ/cm$^2$. The values vary depending on chargeability of the toner T to be used, a configuration of the cartridge CR, or the like and are thus not limited thereto, and are decided in accordance with each configuration. In addition, the image forming apparatus 1 of the first example embodiment performs image formation with the dark portion potential Vd of the photosensitive drum 20 and the negative developing voltage Vb.

First Comparative Example Embodiment

Figure 7:
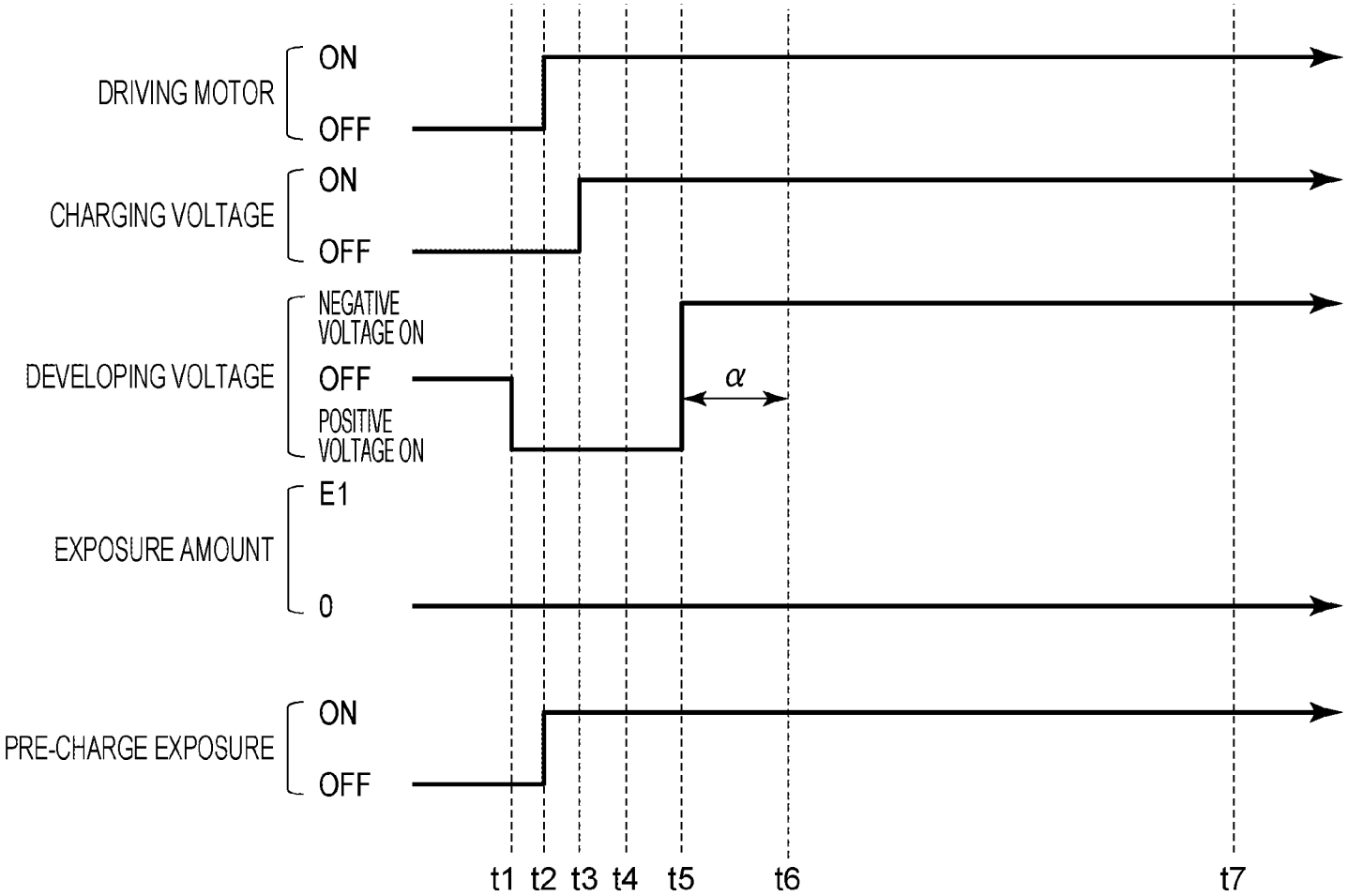
FIG. 7 is a sequence chart of a pre-rotation operation of the image forming apparatus in a first comparative example embodiment.
Figure 8:
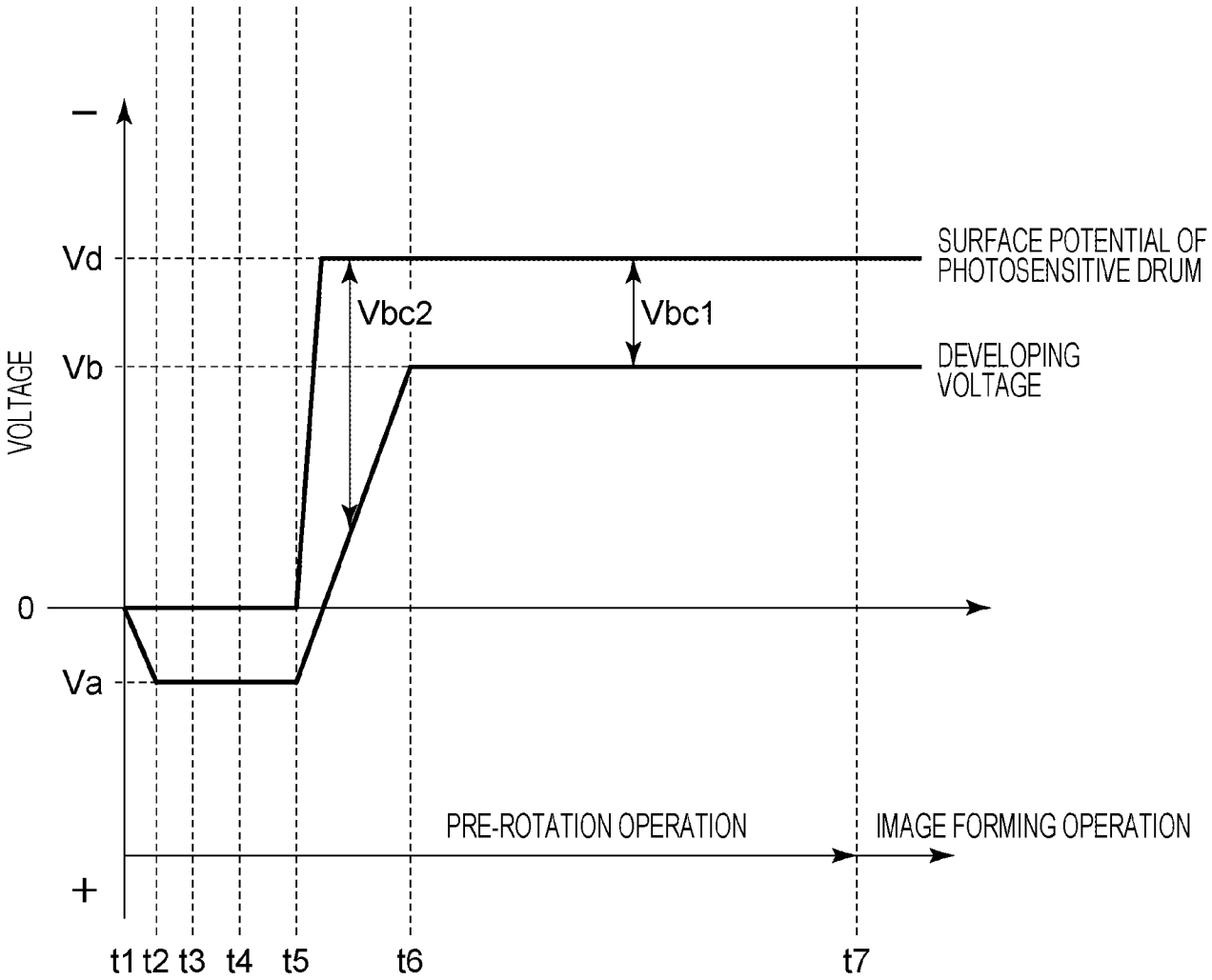
FIG. 8 illustrates shift of a voltage in the pre-rotation operation of the image forming apparatus in the first comparative example embodiment.

Next, a pre-rotation operation in a first comparative example embodiment will be described with reference to FIGS. 7 and 8. FIG. 7 is a timing chart of the driving motor, the charging voltage, the developing voltage, the exposure amount, and pre-charge exposure during the pre-rotation operation in first comparative example embodiment. FIG. 8 illustrates shift with time of the surface potential of the photosensitive drum 20 and the developing voltage at a development position during the pre-rotation operation in the first comparative example embodiment.

As illustrated in FIG. 7, the first comparative example embodiment is different from the first example embodiment in that the exposure unit 100 does not emit light in the rising time α of the developing voltage during the pre-rotation operation. FIG. 8 illustrates a potential relationship when the exposure unit 100 is not turned ON during the pre-rotation operation. In FIG. 8, in a section from t5 to t6, rising of the surface potential of the photosensitive drum 20, that is, rising of the charging voltage is earlier than rising of the developing voltage and back contrast Vbc2 is large over a proper value of the back contrast Vbc1. Since the back contrast Vbc2 exceeds a predetermined range, the reversal fog toner transfers from the developing roller 30 to the photosensitive drum 20 and the toner T is wastefully consumed. In the first comparative example embodiment, while the back contrast Vbc1 is 150 V, the back contrast Vbc2 is 350 V. Thus, in a case of the first comparative example embodiment, toner consumption due to the reversal fog becomes remarkable as illustrated in FIG. 3. For the foregoing reason, in a case where exposure by the exposure unit 100 is not performed during rising of the developing voltage in the pre-rotation operation, the fog in which the fog toner is supplied from the developing roller 30 onto the surface of the photosensitive drum 20 is generated.

As described above, the first example embodiment is characterized in that the control portion 101 controls the exposure unit 100 as follows. A period during which control is performed so that the developing voltage to be applied to the developing roller 30 is changed from a first developing voltage to a second developing voltage smaller than the first developing voltage is provided. The period is set as a period from when the first developing voltage starts to be changed to the second developing voltage until the first developing voltage is completed to be changed to the second developing voltage. During the period, a first region to a second region on the surface of the photosensitive drum 20 charged by the charging roller 21 pass through the development portion in a rotational direction of the photosensitive drum 20. Control is performed so that the first region exposed to light with a first exposure amount by the exposure unit 100 passes through the development portion applied with the first developing voltage. After that, the exposure amount of the exposure unit 100 is changed from the first exposure amount to a second exposure amount smaller than the first exposure amount so that the second region exposed to light with the second exposure amount by the exposure unit 100 passes through the development portion applied with the second developing voltage. That is, in the period from when the developing voltage starts to be changed from the first developing voltage to the second developing voltage until the first developing voltage is completed to be changed to the second developing voltage, the non-image forming portion on the photosensitive drum 20 charged by the charging roller 21 is exposed to light by the exposure unit 100. Then, in a state where the toner T is able to be supplied from the developing roller 30 to the photosensitive drum 20, the exposure amount by which the surface of the photosensitive drum 20 passing through the development portion is exposed to light by the exposure unit 100 from when the period starts until the exposure amount is changed from the first exposure amount to the second exposure amount. This suppresses the fog generated in rising of the charging voltage applying portion 120 and the developing voltage applying portion 130 so that toner consumption is able to be suppressed.

Further, in a period during which the developing voltage rises, the exposure amount is changed so that the back contrast Vbc that is a difference between the surface potential of the photosensitive drum 20 and the developing voltage in the development portion is in a fixed range. The back contrast Vbc is desired to be the same as the back contrast Vbc during image formation. Since the back contrast Vbc needs to be fixed in accordance with rising of the developing voltage, it is desirable that the charging voltage applying portion 120 and the exposure unit 100 are controlled in accordance with a slope of rising of the developing voltage.

Note that, though the contact developing system of developing toner by making the photosensitive drum 20 and the developing roller 30 contact with each other is adopted in the first example embodiment, a noncontact developing system of performing development by providing a clearance between the photosensitive drum 20 and the developing roller 30 may be used.

Second Example Embodiment

A second example embodiment will now be herein described. The same configuration as that of the first example embodiment will be given the same reference sign and detailed description thereof will be omitted. Though the pre-rotation operation of the image forming apparatus 1 is described in the first example embodiment, 6) post-rotation operation described above in the image forming apparatus 1 illustrated in FIG. 4 will be described in the second example embodiment.

1. Example Control in Post-Rotation Operation

Figure 9:
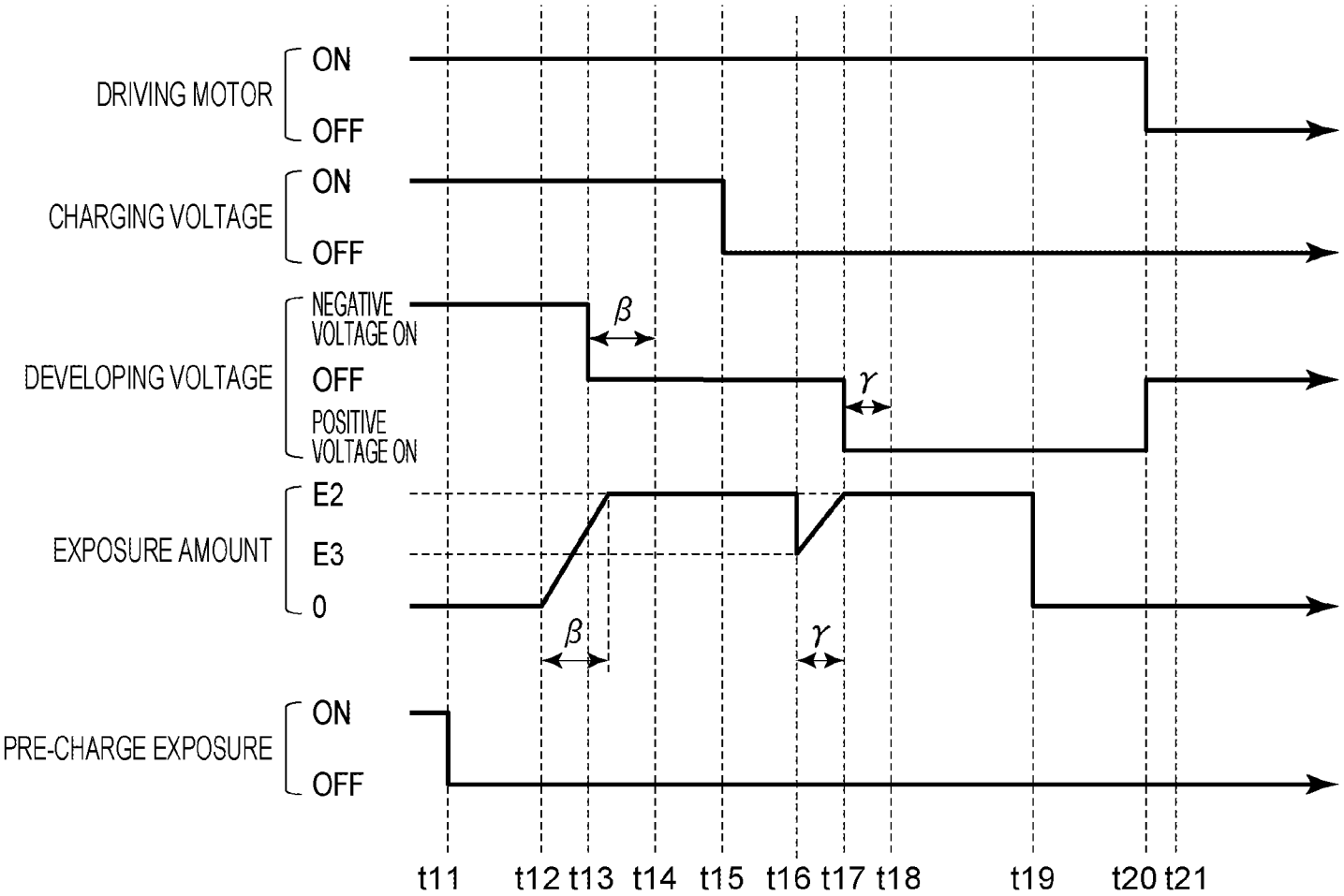
FIG. 9 is a sequence chart of a post-rotation operation of the image forming apparatus in the first example embodiment.
Figure 10:
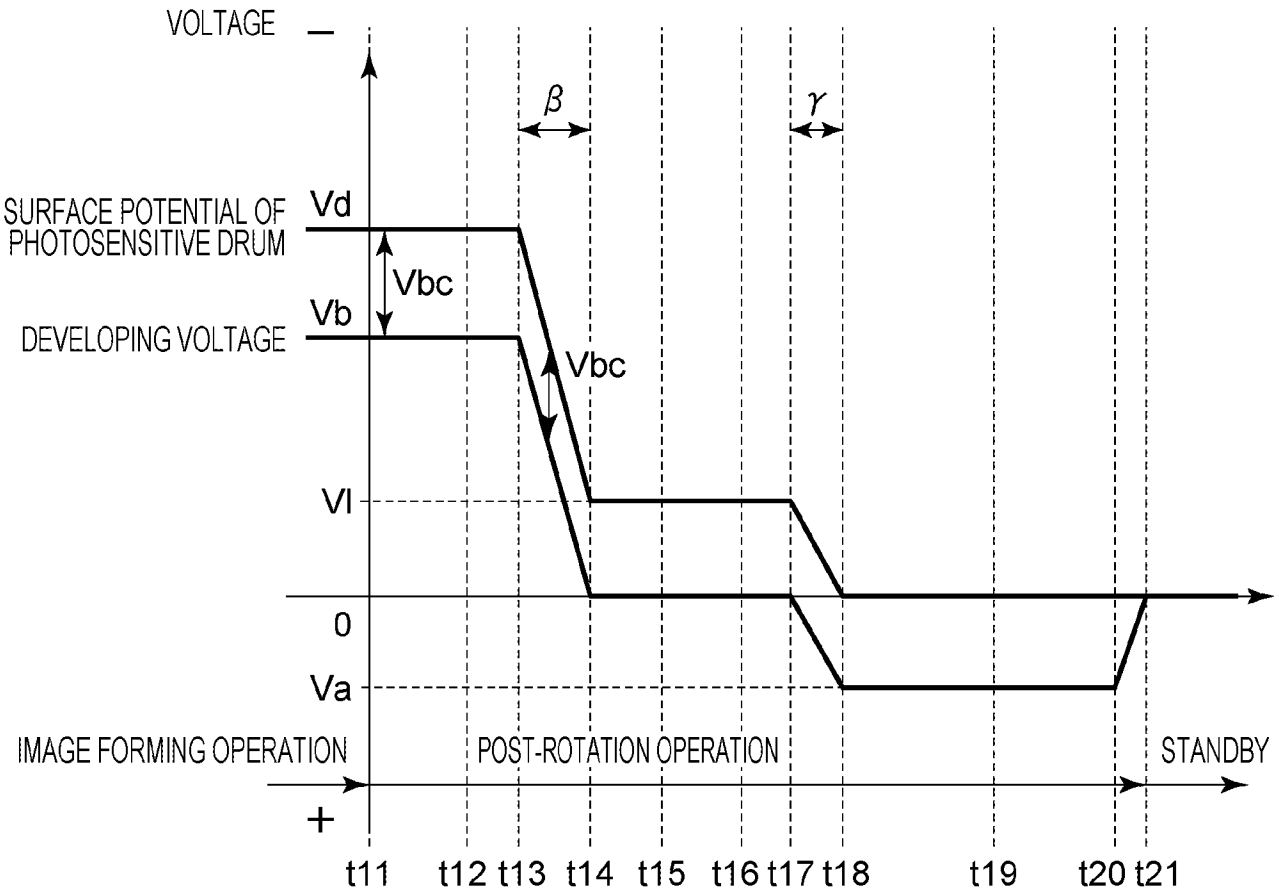
FIG. 10 illustrates shift of a voltage in the post-rotation operation of the image forming apparatus in the first example embodiment.

With reference to FIGS. 9 and 10, 6) post-rotation operation described above in the second example embodiment will be specifically described. FIG. 9 is a timing chart of the driving motor, the charging voltage, the developing voltage, the exposure amount, and pre-charge exposure during the post-rotation operation. FIG. 10 illustrates shift with time of the surface potential of the photosensitive drum 20 and the developing voltage in the development portion during the post-rotation operation.

After the image forming operation ends, the post-rotation operation as an image formation end operation is performed to prepare for a next image forming job. In the post-rotation operation, each voltage is turned OFF and the surface potential of the photosensitive drum 20 is removed. By removing the surface potential of the photosensitive drum 20, the back contrast Vbc is able to be controlled in a proper range during a next pre-rotation operation.

In FIG. 9, in the post-rotation operation, first, the pre-charge exposure unit 23 is turned OFF at t11. The pre-charge exposure unit 23 has a wide exposure area where the surface of the photosensitive drum 20 is irradiated with light and also has a great variation in the exposure amount. Thus, during the post-rotation operation in which the surface potential of the photosensitive drum 20 needs to be accurately controlled, the pre-charge exposure unit 23 is turned OFF. In the second example embodiment, instead of the exposure by the pre-charge exposure unit 23, the removal of the surface potential of the photosensitive drum 20 is controlled by the exposure unit 100.

Subsequently, before the developing voltage Vdc is turned OFF at t13, the surface of the photosensitive drum 20 that is positioned in the development portion when the developing voltage Vdc is turned OFF is subjected to laser exposure by the exposure unit 100 at t12. The exposure amount is controlled to be gradually increased to an exposure amount E2 during β in FIG. 9 correspondingly to a falling time β (period from t13 to t14) of the developing voltage Vdc. In this manner, by controlling the exposure amount of the exposure unit 100 correspondingly to falling of the developing voltage Vdc, the surface potential of the photosensitive drum 20 is able to be removed as the developing voltage Vdc is turned OFF, while keeping the back contrast Vbc in the proper range. In the second example embodiment, the falling time β of the negative developing voltage Vb during the period from t13 to t14 is 100 msec. In the laser exposure by the exposure unit 100, after the exposure amount is gradually increased to the predetermined exposure amount E2, the surface of the photosensitive drum 20 is irradiated with light for one turn or more of the photosensitive drum 20 and the surface potential is removed to the light portion potential Vl. Subsequently, in order to remove the surface potential of the photosensitive drum 20 from the light portion potential Vl to substantially 0 V, the charging voltage is turned OFF at t15, and then, the positive developing voltage Va is applied at a timing of t17 where the surface of the photosensitive drum 20 charging of which is turned OFF reaches the development portion. At this time, since the developing voltage has a rising characteristic also during rising of the positive developing voltage Va, the exposure amount of the exposure unit 100 with respect to the surface of the photosensitive drum 20 is controlled in a period from t16 to t17 correspondingly to a rising time γ (period from t17 to t18) of the positive developing voltage Va. The exposure amount is controlled so that the exposure amount is reduced from E2 to E3 (E2>E3) at t16 and the exposure amount is then gradually changed from E3 to E2 during a period (γ) up to t17 correspondingly to a positive rising characteristic of the developing voltage Vdc. In the second example embodiment, the rising time γ of the positive developing voltage Va is 50 msec. After the surface of the photosensitive drum 20 is exposed to light for one turn or more from t17, the exposure by the exposure unit 100 is turned OFF at t19. Driving of the photosensitive drum 20 and the developing roller 30 is stopped and the positive developing voltage Va is turned OFF at t20. After t20, a standby state is entered at 121.

In this manner, by changing the exposure amount of the exposure unit 100 in accordance with the falling characteristic P when the developing voltage Vdc is turned OFF, a setting value of the back contrast Vbc is able to be controlled in the proper range where no fog is generated. Moreover, by changing the exposure amount of the exposure unit 100 in accordance with the rising characteristic γ when the positive developing voltage Va is turned ON, the back contrast Vbc is able to be controlled in a predetermined range. This suppresses the fog during the post-rotation operation so that toner consumption is able to be suppressed. Further, by removing electricity of the surface of the photosensitive drum 20 in the post-rotation operation, the surface potential of the photosensitive drum 20 between the charging roller 21 and the developing roller 30 in the rotational direction of the photosensitive drum 20 is removed also when a pre-rotation operation is performed for a next print job. Thus, the surface potential formed on the surface of the photosensitive drum 20 is substantially 0 V. As a result, next time, the back contrast Vbc is able to be properly controlled by starting the pre-rotation operation upon application of the positive developing voltage Va, toner consumption due to the fog during the pre-rotation operation is able to be suppressed.

The proper range of the back contrast Vbc in the second example embodiment is 130 V or more and 170 V or less. At least the back contrast Vbc is set to be in the predetermined range during the periods of the falling time 3 of the developing voltage Vdc and the rising time γ of the positive developing voltage Va. In addition, Va=+150 V, Vd=−500 V, Vb=−350 V, Vl=−150 V, E0=E2=0.35 μJ/cm$^2$, and E3=0.16 μJ/cm$^2$ are set. The values vary depending on chargeability of the toner T to be used, the configuration of the cartridge CR, or the like and are thus not limited thereto, and are decided in accordance with each configuration. In addition, in a case where the surface potential formed on the surface of the photosensitive drum 20 is not substantially 0 V when the exposure by the exposure unit 100 is turned OFF at t19, the surface of the photosensitive drum 20 may be exposed to light by the pre-charge exposure unit 23 instead of the exposure unit 100.

Second Comparative Example Embodiment

Figure 11:
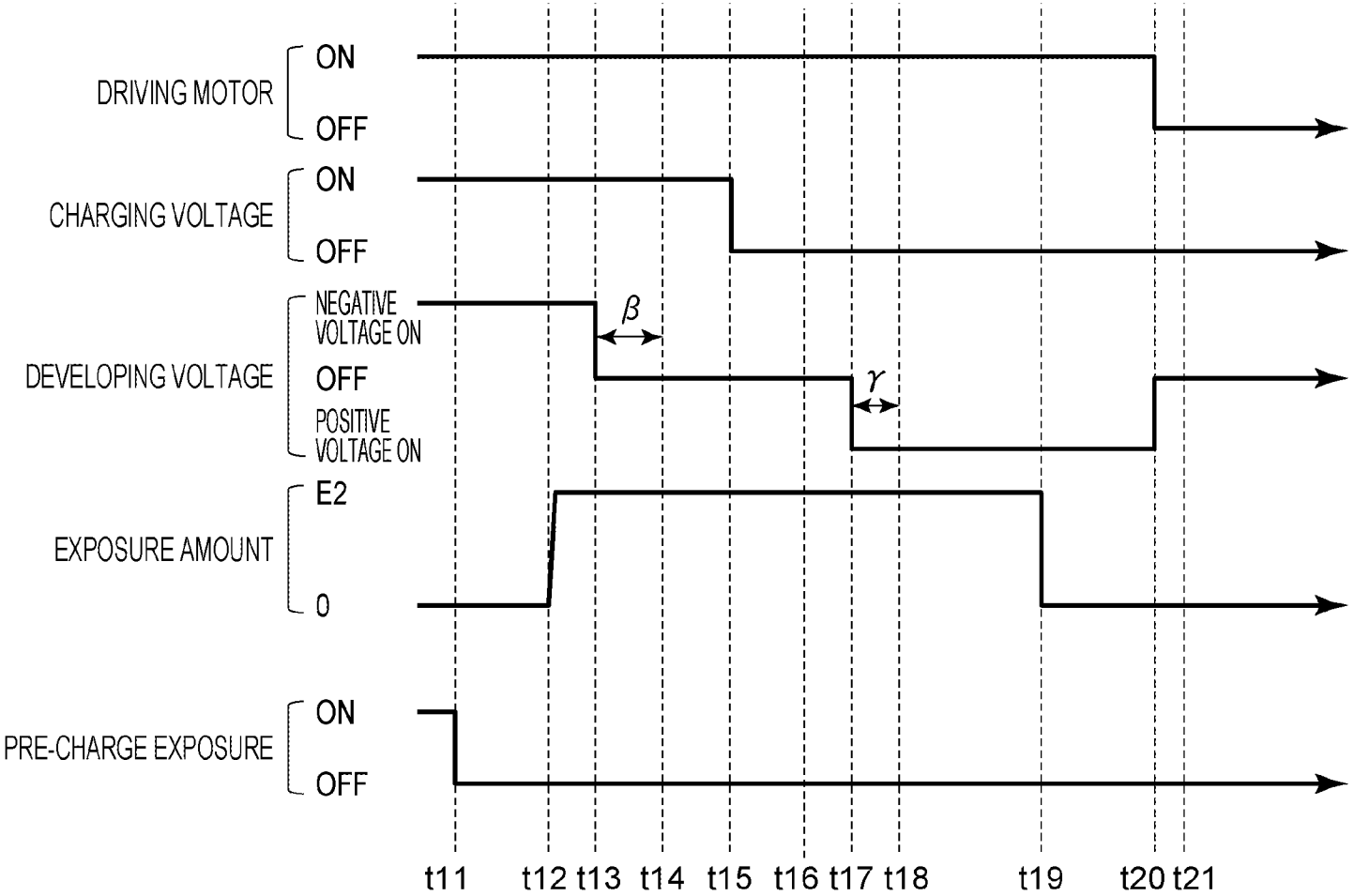
FIG. 11 is a sequence chart of a post-rotation operation of the image forming apparatus in a second comparative example embodiment.
Figure 12:
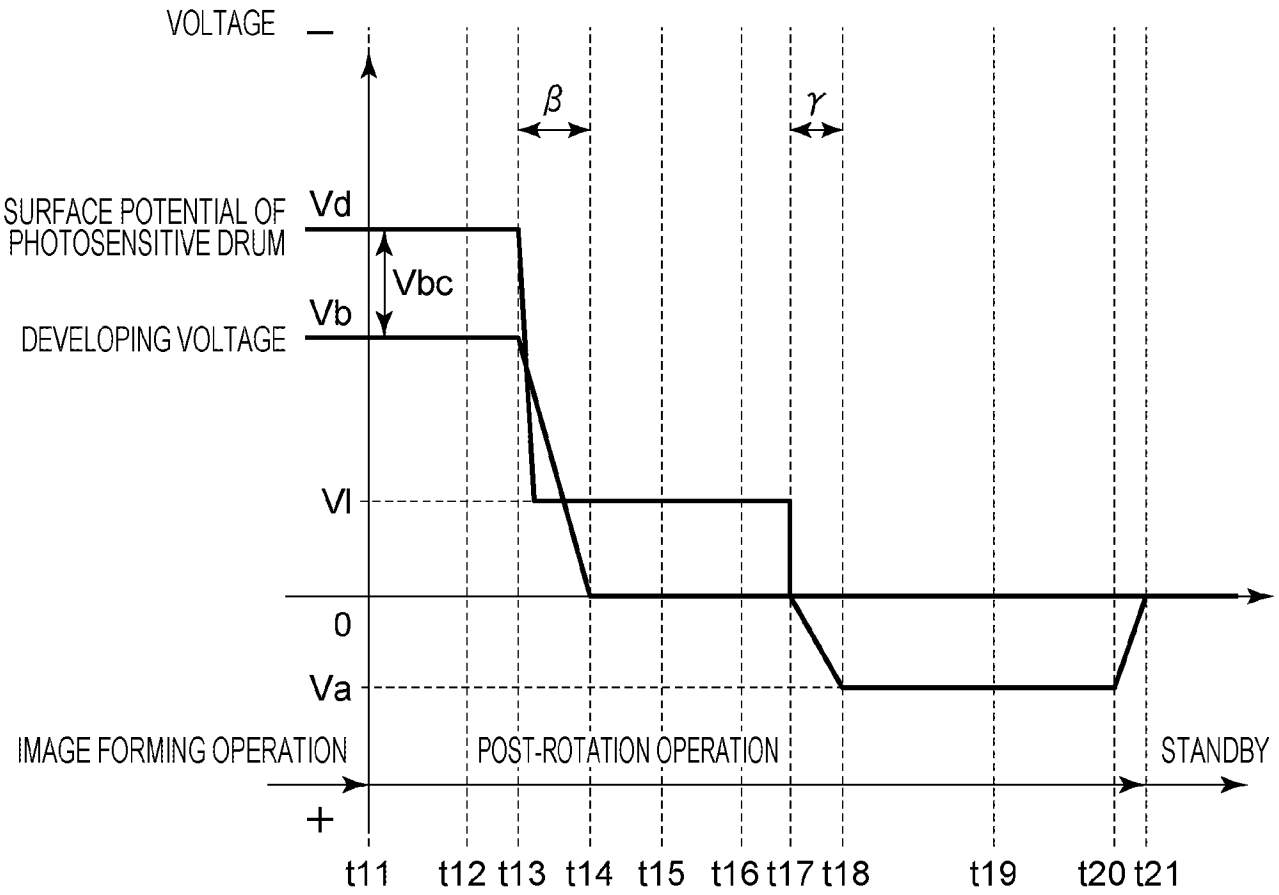
FIG. 12 illustrates shift of a voltage in the post-rotation operation of the image forming apparatus in the second comparative example embodiment.

Next, a post-rotation operation in a second comparative example embodiment will be described with reference to FIGS. 11 and 12. FIG. 11 is a timing chart of the driving motor, the charging voltage, the developing voltage, the exposure amount, and pre-charge exposure during the post-rotation operation in the second comparative example embodiment. FIG. 12 illustrates shift with time of the surface potential of the photosensitive drum 20 and the developing voltage at a development position during the post-rotation operation in the second comparative example embodiment.

As illustrated in FIG. 11, the second comparative example embodiment is different from the second example embodiment in that the exposure amount of the exposure unit 100 at t13 during the post-rotation operation is controlled at a fixed value E2. As illustrated in FIG. 12, when the exposure amount of the exposure unit 100 is controlled to be fixed at E2, a region where the developing voltage Vdc during the period from t13 to t14 is larger than the surface potential of the photosensitive drum 20 is generated. In the region, the toner T is developed and the fog is generated so that the toner T is wastefully consumed. The fog is normal fog in which the toner T having the normal polarity is developed, and is thus attached to the transfer roller 4 to which a voltage having a positive polarity is applied and a reverse side of a sheet may become dirty when image formation is performed.

As described above, the second example embodiment is characterized in that, in addition to the characteristic of the first example embodiment, the exposure unit 100 is further controlled as follows by the control portion 101. A period during which control is performed so that the developing voltage to be applied to the developing roller 30 is changed from a first developing voltage to a second developing voltage larger than the first developing voltage is provided. The period is set as a period from when the first developing voltage starts to be changed to the second developing voltage until the first developing voltage is completed to be changed to the second developing voltage. During the period, a first region to a second region on the surface of the photosensitive drum 20 charged by the charging roller 21 pass through the development portion in the rotational direction of the photosensitive drum 20. Control is performed so that the first region exposed to light with a first exposure amount by the exposure unit 100 passes through the development portion applied with the first developing voltage. After that, the exposure amount of the exposure unit 100 is changed from the first exposure amount to a second exposure amount larger than the first exposure amount so that the second region exposed to light with the second exposure amount by the exposure unit 100 passes through the development portion applied with the second developing voltage. That is, in the period from when the developing voltage starts to be changed from the first developing voltage to the second developing voltage until the first developing voltage is completed to be changed to the second developing voltage, the non-image forming portion of the photosensitive drum 20 charged by the charging roller 21 is exposed to light by the exposure unit 100. Then, in a state where the toner T is able to be supplied from the developing roller 30 to the photosensitive drum 20, the exposure amount by which the surface of the photosensitive drum 20 passing through the development portion is exposed to light by the exposure unit 100 from when the period starts until the exposure amount is changed from the first exposure amount to the second exposure amount. This suppresses the fog generated in rising and falling of the charging voltage applying portion 120 and the developing voltage applying portion 130 so that toner consumption is able to be suppressed. Accordingly, the back contrast Vbc is able to be properly controlled also during falling of the negative developing voltage Vb and during rising of the positive developing voltage Va. More specifically, the fog generated during falling of the negative developing voltage Vb and during rising of the positive developing voltage Va is suppressed so that toner consumption is able to be suppressed.

Note that, though the normal polarity of the toner T is the negative polarity in the first example embodiment and the second example embodiment, toner having the positive polarity is also applicable. In a case where the toner having the negative polarity is used, sequences of the pre-rotation operation described in first example embodiment and the post-rotation operation described in the second example embodiment are applicable. The toner having the positive polarity is applied so that rising of the developing voltage in the pre-rotation operation in first example embodiment is falling of the developing voltage in the post-rotation operation and falling of the developing voltage in the post-rotation operation in second example embodiment is rising of the developing voltage in the pre-rotation operation.

In first example embodiment, when the image formation start signal S is input at t1, the developing voltage Vdc is turned ON and the positive developing voltage Va is applied to the developing roller 30. Since the surface potential of the photosensitive drum 20 when the operation starts at t1 is substantially 0 V at all times, the positive developing voltage Va is applied to the developing roller 30 so that the proper back contrast Vbc is formed. Since the photosensitive drum 20 is exposed to light by the exposure unit 100 in a period from t15 to t16 in the second example embodiment, the surface potential of the photosensitive drum 20 after the post-rotation operation ends is substantially 0 V. However, when the exposure unit 100 performs the exposure for a long time with the exposure amount forming the light portion potential Vl, adverse effects such as lowering of sensitivity due to optical fatigue of the photosensitive drum 20 and abrasion of the surface of the photosensitive drum 20 may be caused. [First Modified Example Embodiment]

Thus, in a first modified example embodiment, by setting the surface potential of the photosensitive drum 20 to the light portion potential Vl without exposing the photosensitive drum 20 to light up to substantially 0 V by the exposure unit 100, an adverse effect caused by exposure is suppressed. Further, in the second example embodiment, exposure by the exposure unit 100 is performed so that the surface potential of the photosensitive drum 20 is substantially 0 V in a period from t15 to t19. However, since such exposure is not necessary in a first modified example embodiment, a time is able to be shortened by reducing an execution time from t15 to t19. Thus, there is also an advantage that the post-rotation operation is shortened, which results in reduction of a downtime and reduction of power consumption. In a case where the light portion potential Vl is formed on the surface of the photosensitive drum 20 without removing the surface potential of the photosensitive drum 20, the surface potential of the photosensitive drum 20 between the charging roller 21 and the developing roller 30 in the rotational direction of the photosensitive drum 20 changes due to attenuation. Control in such a state will be described below.

Figure 13:
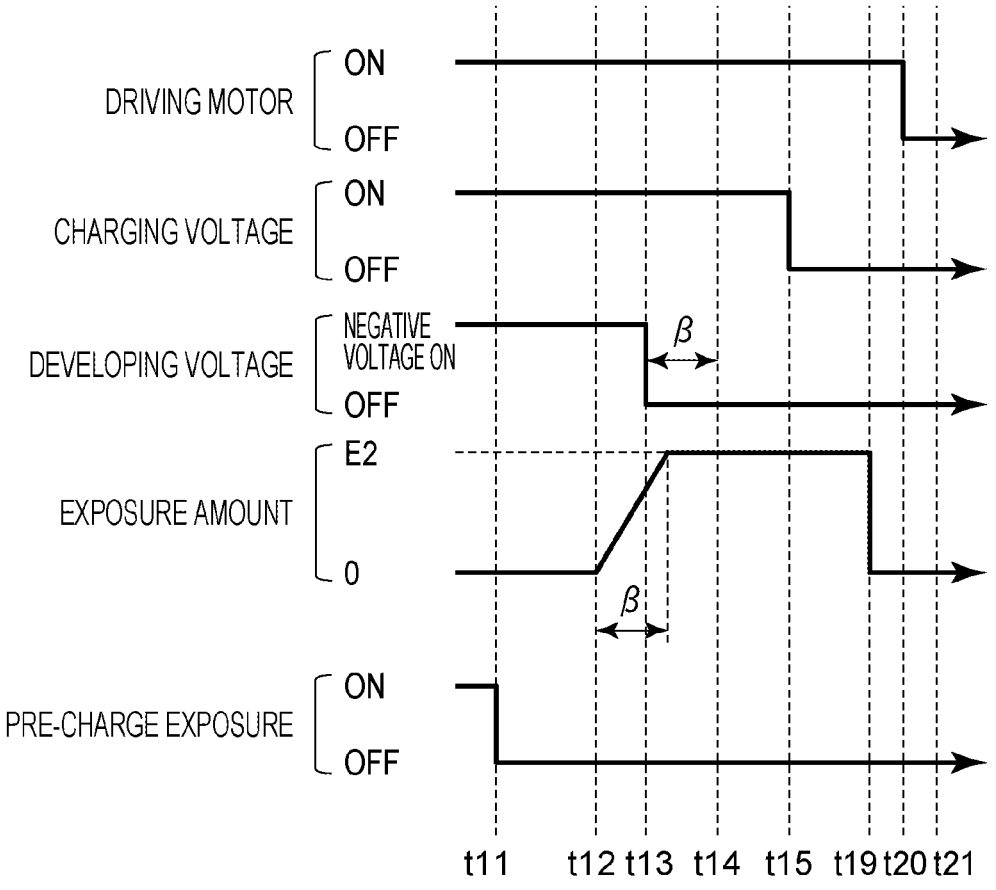
FIG. 13 is a sequence chart of a post-rotation operation of the image forming apparatus in a modified first example embodiment.
Figure 14:
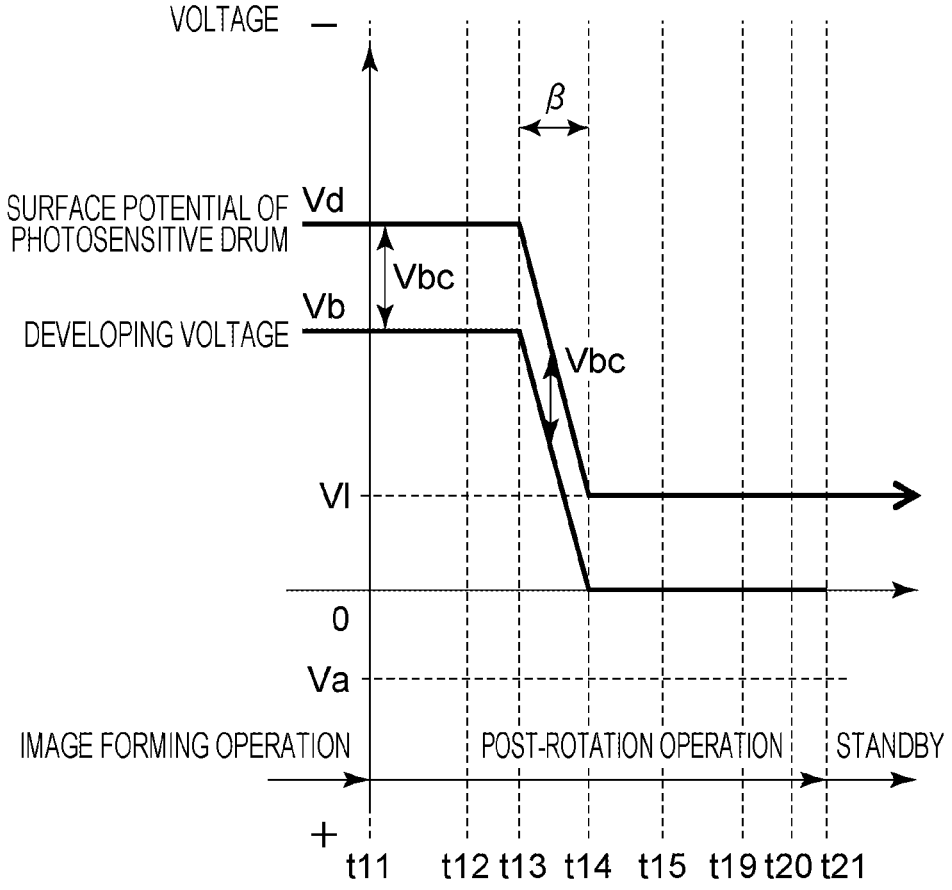
FIG. 14 illustrates shift of a voltage in the post-rotation operation of the image forming apparatus in the modified first example embodiment.

A post-rotation operation in first modified example embodiment will be described with reference to FIGS. 13 and 14. FIG. 13 is a timing chart of the driving motor, the charging voltage, the developing voltage, the exposure amount, and pre-charge exposure during the post-rotation operation in the first modified example embodiment. FIG. 14 illustrates shift with time of the surface potential of the photosensitive drum 20 and the developing voltage at the development position during the post-rotation operation in the first modified example embodiment.

A period from t11 to t13 in FIGS. 13 and 14 is the same as that in the second example embodiment, so that description thereof will be omitted. In the first modified example embodiment, the falling time β of the negative developing voltage Vb is 100 msec which is the same as β in the second example embodiment. Laser exposure L by the exposure unit 100 is gradually increased to a predetermined exposure amount E2, and is then radiated to the surface of the photosensitive drum 20 for one turn or more of the photosensitive drum 20 and adjusted to the light portion potential Vl. At a time when the negative developing voltage Vb falls, the developing voltage Vdc is turned OFF. Subsequently, the charging voltage is turned OFF at t15, and the exposure of the exposure unit 100 is turned OFF at t19 where the surface of the photosensitive drum 20 positioned in a charging portion when the charging voltage is turned OFF reaches an exposure position. By such an operation, the period from t16 to t18 in the second example embodiment is reduced. Then, driving of the photosensitive drum 20 and the developing roller 30 is stopped at t20. After t20, a standby state is entered at t21.

In this manner, by changing the exposure amount of the exposure unit 100 in accordance with the falling characteristic P when the developing voltage Vdc is turned OFF, a setting value of the back contrast Vbc is able to be controlled in the proper range where no fog is generated. Further, by controlling the exposure unit 100 to reduce the exposure amount, an adverse effect due to exposure of the photosensitive drum 20 to light is able to be suppressed. Additionally, it is possible to shorten the post-rotation as compared to the second example embodiment. According to the foregoing effect, in the first modified example embodiment, the fog generated during the post-rotation operation is suppressed so that toner consumption is able to be suppressed and a downtime is able to be reduced.

Figure 15:
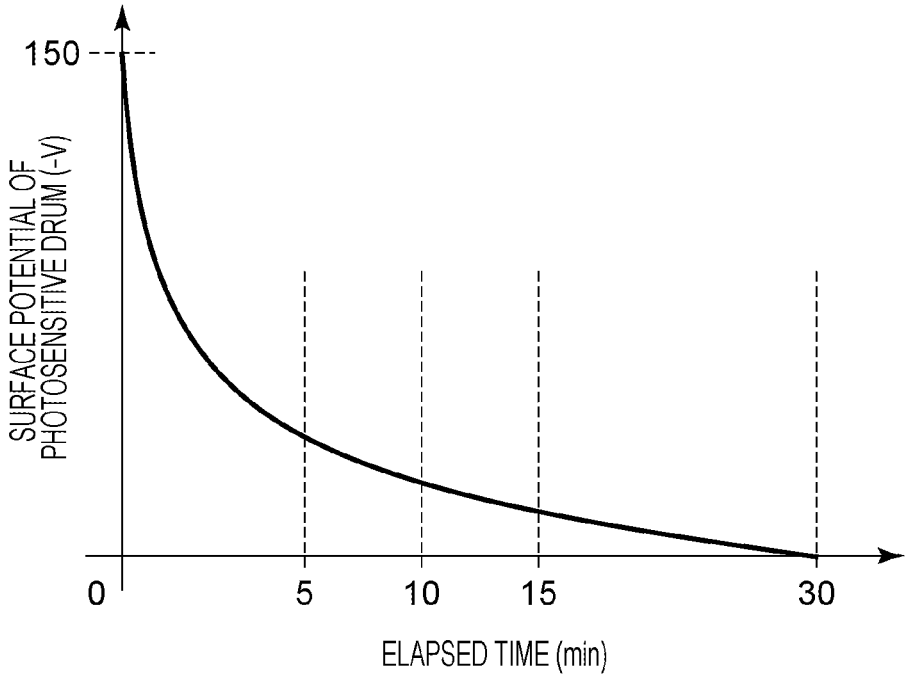
FIG. 15 illustrates attenuation of a surface potential of a photosensitive drum in the modified first example embodiment.

However, in the first modified example embodiment, also after the post-rotation operation ends and the standby state is entered, the potential is formed on the surface of the photosensitive drum 20. Thus, since the surface potential of the photosensitive drum 20 changes depending on a situation where a next image forming operation starts, the developing voltage Vdc to be applied during the pre-rotation operation needs to be controlled in accordance with the surface potential of the photosensitive drum 20. For controlling the developing voltage Vdc, an attenuation amount of the surface potential of the photosensitive drum 20, which is caused by natural attenuation of electric charges, is stored in the storage portion 103 in advance in first modified example embodiment. Further, it is characterized in that a time after end of image formation is measured and control is performed so that the developing voltage Vdc according to the measured time is applied to the developing roller 30. Specifically, a time from when the standby state starts at t21 in FIG. 13 till when a new job starts is measured. For example, when the job starts immediately after t21, 0 V is applied to the developing voltage Vdc (the developing voltage Vdc is turned OFF). When the job starts immediately after t21, the surface potential of the photosensitive drum 20 hardly attenuates. Thus, when the positive developing voltage Va is applied as in the first example embodiment, the back contrast Vbc increases so that the reversal fog is generated. Here, attenuation of the surface potential of the photosensitive drum 20 in the present modified example is illustrated in FIG. 15. FIG. 15 illustrates a change with time of the surface potential of the photosensitive drum 20 when the photosensitive drum 20 is left for a fixed time inside the image forming apparatus 1 while the image forming apparatus 1 is in a standby state under an environment with 23° C. and 50%. The surface potential of the photosensitive drum 20 attenuates from the light portion potential Vl=−150 V as time elapses and reaches substantially 0 V after 30 minutes. Thus, when the photosensitive drum 20 is left for 30 minutes or more, the control of FIG. 5 in the first example embodiment may be performed from t1. In the first modified example embodiment, an attenuation curve as in FIG. 15 is stored in the storage portion 103 in advance. By using the attenuation curve stored in the storage portion 103 and an elapsed time of standby, the developing voltage Vdc to be applied during the initial rotation operation and the pre-rotation operation is decided. In the first modified example embodiment, though an attenuation amount of the surface potential of the photosensitive drum 20 is stored in the storage portion 103 in advance, the surface potential of the photosensitive drum 20 may be directly measured during the initial rotation operation and the pre-rotation operation.

In the first modified example embodiment, in order to properly set the back contrast Vbc, 0 V<Va<+150 V, Vd=−500 V, Vb=−350 V, Vl=−150 V, and E2=0.35 μJ/cm$^2$ are set. The values vary depending on chargeability of the toner T to be used, the configuration of the cartridge CR, or the like and are thus not limited thereto, and are decided in accordance with each configuration. In addition, though the developing voltage Vdc is set to be in a range of the positive developing voltage Va, the negative developing voltage Vb may be selected in accordance with a situation of generation of the fog due to a change in an environment or an operation situation.

The negative developing voltage Vb is selected, for example, in a case where a timing t19 where exposure is turned OFF is performed prior to a timing t15 where the charging voltage is turned OFF. In this case, a job is completed in a state where the surface potential of the photosensitive drum 20 is the dark portion potential Vd. Also when the job ends while the surface potential is the dark portion potential Vd, the first modified example embodiment is able to be applied. As the exposure amount is small, it is possible to further suppress lowering of sensitivity due to optical fatigue of the photosensitive drum 20 and abrasion of the surface of the photosensitive drum 20 as compared to the first modified example embodiment. In such a case, the attenuation curve for Vd as illustrated in FIG. 15 may be stored in the storage portion 103.

Third Example Embodiment

A third example embodiment will be described. The same configuration as that of the first example embodiment will be given the same reference sign and detailed description thereof will be omitted.

Rising and falling of the developing voltage Vdc vary depending on a characteristic and a variation of a part used for the developing voltage applying portion (developing high voltage) 130. In particular, rising and falling greatly depend on a characteristic of a transformer. Even when a transformer having the same rising and falling characteristics is to be used, it is difficult to provide a transformer having the same characteristics. Thus, in the third example embodiment, information about the rising and falling characteristics of the developing voltage Vdc is stored in the storage portion 103. On the basis of the information stored in the storage portion 103, the exposure amount of the exposure unit 100 during the initial rotation operation, the pre-rotation operation, or the post-rotation operation is controlled. As a result, toner consumption is further suppressed in the initial rotation operation, the pre-rotation operation, and the post-rotation operation regardless of the characteristics of the developing voltage applying portion 130 to be used and an image forming apparatus having high production stability is able to be provided.

A table 1 is a table in which the rising time α of the negative developing voltage Vb, the falling time β of the negative developing voltage Vb, and the rising time γ of the positive developing voltage Va are compared in image forming apparatuses X, Y, and Z which use transformers by different vendors and include developing voltage applying portions 130.

TABLE 1

| Transformer of image forming apparatus | Rising time α of negative developing voltage [msec] | Falling time β of negative developing voltage [msec] | Rising time γ of positive developing voltage [msec] |
|---|---|---|---|
| X | 75 | 100 | 50 |
| Y | 100 | 150 | 75 |
| Z | 150 | 250 | 100 |

As indicated in the table 1, rising and falling times of the developing voltage Vdc are different between the developing voltage applying portions 130 of the image forming apparatuses X, Y, and Z. Here, the times α, β, and γ are respectively stored in storage portions 103 of the image forming apparatuses X, Y, and Z in advance during manufacturing. The initial rotation operation, the pre-rotation operation, and the post-rotation operation are performed by changing the exposure amount of the exposure unit 100 in accordance with the times α, β, and γ that are stored. The information to be stored is not limited thereto, and other information about rising and falling of the developing voltage Vdc, such as information about a vendor of a transformer, may be stored instead of the times.

The pre-rotation operation will be specifically described with reference to FIG. 5. The surface of the photosensitive drum 20 is exposed to light with the exposure amount E1 by the exposure unit 100 at t4 and the exposure amount is gradually reduced from the exposure amount E1. At this time, on the basis of the rising time α of the negative developing voltage Vb, which is stored in the storage portion 103, control is performed so that the exposure amount of the exposure unit 100 is gradually changed to 0 from E1 over α=75 msec in the main body X. Similarly, control is performed so that the exposure amount of the exposure unit 100 is gradually changed to 0 from E1 over α=100 msec in the main body Y and over α=150 msec in the main body Z. By performing such control, the back contrast Vbc during the pre-rotation operation is able to be controlled more properly regardless of the rising and falling characteristics of the developing voltage applying portion 130 that outputs the developing voltage Vdc. Thus, the back contrast Vbc when the negative developing voltage Vb rises is able to be controlled more accurately, thus making it possible to suppress generation of fog and further suppress toner consumption.

Next, the post-rotation operation will be specifically described with reference to FIG. 9. The surface of the photosensitive drum 20 is exposed to light by the exposure unit 100 at t12. At this time, on the basis of the falling time β of the negative developing voltage Vb, which is stored in the storage portion 103, the exposure unit 100 is controlled so that the exposure amount is gradually changed to E2 from 0 over β=100 msec in the image forming apparatus X. Similarly, the exposure unit 100 is controlled so that the exposure amount is gradually changed to E2 from 0 over β=150 msec in the image forming apparatus Y and over β=250 msec in the image forming apparatus Z. Then, after the exposure amount is changed to E3 at t16, the exposure unit 100 is controlled so that the exposure amount is gradually increased to E2 until t17. At this time, on the basis of the rising time γ of the positive developing voltage Va, which is stored in the storage portion 103, the exposure unit 100 is controlled so that the exposure amount is gradually changed to E2 from E3 over γ=50 msec in the image forming apparatus X. Similarly, the exposure unit 100 is controlled so that the exposure amount is gradually changed to E2 from E3 over γ=75 msec in the image forming apparatus Y and over γ=100 msec in the image forming apparatus Z. By performing such control, the back contrast Vbc during the post-rotation operation is able to be controlled more properly regardless of the rising and falling characteristics of the developing voltage applying portion 130 that outputs the developing voltage Vdc. Thus, the back contrast Vbc when the negative developing voltage Vb falls and when the positive developing voltage Va rises is able to be controlled more accurately, thus making it possible to suppress generation of the fog and further suppress toner consumption.

As described above, in the third example embodiment, information about the rising and falling characteristics of the developing voltage applying portion 130 is stored in the storage portion 103 and the exposure amount of the exposure unit 100 during the initial rotation operation, the pre-rotation operation, or the post-rotation operation is controlled on the basis of the stored information. During the initial rotation operation, the pre-rotation operation, or the post-rotation operation, the back contrast Vbc is properly controlled regardless of the rising and falling characteristics of the developing voltage applying portion 130, thus making it possible to suppress the fog and suppress toner consumption.

While the present disclosure has been described with reference to disclosure embodiments, it is to be understood that the disclosure is not limited to the disclosed disclosure embodiments. The scope of the following claims is to be accorded the broadest interpretation so as to encompass all such modifications and equivalent structures and functions.

This application claims the benefit of Japanese Patent Application No. 2019-061880, filed Mar. 27, 2019, which is hereby incorporated by reference herein in its entirety.

What is claimed is:

1. An image forming apparatus comprising:

a rotatable photosensitive drum;

a charging roller that is arranged so as to face the photosensitive drum and charges a surface of the photosensitive drum so as to form a charging potential at a charging portion opposing the photosensitive drum;

a first exposure unit that exposes to light the surface of the photosensitive drum charged by the charging roller, so as to form an electrostatic latent image on the surface of the photosensitive drum;

a developing member including a developing roller that supplies toner to the electrostatic latent image formed on the photosensitive drum in a development portion facing the photosensitive drum to form a toner image, and that is positioned at a developing position for forming the toner image on the photosensitive drum during an image forming operation;

a transfer roller that transfers the toner image from the photosensitive drum onto a transfer material at a transfer portion;

a charging voltage power source that applies a charging voltage to the charging roller;

a developing voltage power source that applies a developing voltage to the developing roller;

a second exposure unit that exposes the surface of the photosensitive drum so as to remove electric charges formed on the surface of the photosensitive drum on a downstream side of the transfer portion and an upstream side of the charging portion with respect to a rotating direction of the photosensitive drum; and a controller for controlling the image forming operation for forming the toner image on the surface of the photosensitive drum and a non-image forming operation for not forming the toner image on the surface of the photosensitive drum by controlling the first exposure unit, the charging voltage power source, the developing voltage power source and the second exposure unit, wherein, during the image forming operation, the controller controls not to expose the surface of the photosensitive drum charged by the charging roller to light by the first exposure unit and to expose the surface of the photosensitive drum charged by the charging roller to light by the second exposure unit, wherein, during the non-image forming operation, the controller performs control to expose the surface of the photosensitive drum charged by the charging roller to light by the first exposure unit and not to expose the surface of the photosensitive drum charged by the charging roller to light by the second exposure unit, and in a state where the developing member is positioned at the developing positon, during a period from when the developing voltage starts to be changed from a first developing voltage, which is applied during the image forming operation, to a second developing voltage larger than the first developing voltage until the developing voltage is completed to be changed to the second developing voltage, the controller controls the first exposure unit so that, after a portion of the surface of the photosensitive drum exposed to light with a first exposure amount by the first exposure unit passes through the development portion, another portion of the surface of the photosensitive drum exposed to light with a second exposure amount larger than the first exposure amount, by the first exposure unit passes through the development portion in accordance with the change of the developing voltage from the first developing voltage to the second developing voltage, and wherein the controller controls the first exposure unit so that the second exposure amount is the same as an exposure amount by which the surface of the photosensitive drum is exposed to light to form the toner image during the image forming operation.

2. The image forming apparatus according to claim 1, wherein the second developing voltage is a developing voltage having a polarity opposite to a normal polarity of the toner.

3. The image forming apparatus according to claim 1, wherein a period of the non-image forming operation is a period of performing a post-rotation operation to be performed after the image forming operation.

4. The image forming apparatus according to claim 3, wherein the developing roller is arranged in contact with the photosensitive drum in the development portion during the post-rotation operation.

* * * * *